US005963754A

United States Patent [19]

Itoh et al.

[11] Patent Number: 5,963,754

[45] Date of Patent: Oct. 5, 1999

[54] MEDIUM DETECTION UNIT, MEDIUM CONVEYANCE APPARATUS AND IMAGE FORMATION SYSTEM INCLUDING A SINGLE SENSOR WHICH DETECTS MEDIUM PASSAGE, A FULLY ACCUMULATED CONDITION AND A JAM CONDITION

[75] Inventors: Fumihiro Itoh; Kazuo Shimada; Hironori Kanno; Katsuei Asano; Nobuyuki Hayashida, all of Kawasaki, Japan

[73] Assignee: Fujitsu Limited, Kawasaki, Japan

[21] Appl. No.: 09/030,808

[22] Filed: Feb. 26, 1998

[30] Foreign Application Priority Data

Jul. 18, 1997 [JP] Japan ..... 9-194002

[51] Int. Cl.[6] ..... G03G 15/00; B65H 7/02

[52] U.S. Cl. ..... 399/21; 271/258.01; 399/393; 399/405

[58] Field of Search ..... 399/21, 405, 393; 271/258.01, 258.03, 258.04

[56] References Cited

U.S. PATENT DOCUMENTS

| | | | |
|---|---|---|---|
| 5,034,771 | 7/1991 | Makita | 399/21 |
| 5,081,508 | 1/1992 | Kotani et al. | 399/21 |
| 5,204,726 | 4/1993 | Choi | 399/21 |
| 5,365,322 | 11/1994 | Hamada et al. | 399/21 |

FOREIGN PATENT DOCUMENTS

| | | |
|---|---|---|
| 62-116470 | 5/1987 | Japan . |
| 62-116471 | 5/1987 | Japan . |

*Primary Examiner*—Fred L Braun

*Attorney, Agent, or Firm*—Armstrong, Westerman, Hattori, McLeland & Naughton

[57] ABSTRACT

A unit which detects a discharged condition of each of media with a simple and low-cost structure. For this purpose, this unit is designed to output a signal indicative of the passage of the medium, a signal indicative of a full accumulated condition of the media within the medium discharged section and a signal representative of the occurrence of a jam condition of the medium during the passage of the medium. This unit is applicable to printers such as an electrophotographic type printer.

12 Claims, 14 Drawing Sheets

MEDIUM DETECTION UNIT, MEDIUM CONVEYANCE APPARATUS AND IMAGE FORMATION SYSTEM INCLUDING A SINGLE SENSOR WHICH DETECTS MEDIUM PASSAGE, A FULLY ACCUMULATED CONDITION AND A JAM CONDITION

BACKGROUND OF THE INVENTION

1) Field of the Invention

The present invention relates to a medium detection unit for detecting a condition of a medium to be discharged through a medium conveyance system into a medium discharged section, a medium conveyance apparatus for conveying and discharging a medium toward a medium discharged section, and an image formation system for transferring an image onto an image transferred material (paper or form serving as a sheet-like medium having a rectangular configuration) for the formation of the image thereon.

2) Description of the Related Art

In general, printer systems (image formation systems) for carrying out printing on paper (transferred material) being a medium have come into widespread use.

Such a printer system is connected through a cable or a network such as LAN to a personal computer to perform printing on paper on the basis of printing data coming from the personal computer. Further, the printer system contains a medium conveyance system therein, and transfers an image onto paper for image formation while conveying the paper through the use of the medium conveyance system and subsequently discharge the image-transferred paper into a stacker.

In a communication system in which the personal computer and the printer system are coupled to each other through a network such as LAN, there are the cases that the personal computer which issues a request for print output is physically remote from the printer system. In this communication system, in case that faults or troubles occur in the printer system, the presence of countermeasures for that fault is desirable. For this reason, requirement has arisen for certainly detecting the medium discharged condition.

SUMMARY OF THE INVENTION

Accordingly, the present invention has been developed with a view to eliminating this problem, and it is therefore an object of this invention to provide a medium detection unit, a medium conveyance apparatus and an image formation system which are capable of coping with faults at occurrence by detecting a medium discharged condition with a simple and low-cost constitution.

For this purpose, a medium detection unit according to this invention fulfills a function to detect a condition of each of media being discharged through a medium conveyance system into a medium discharged section, and is made to output a signal indicative of the passage of the medium, a signal indicative of a fully accumulated condition of the media within the medium discharged section and a signal representative of the fact that the medium gets into a jam condition during the passage of the medium.

Furthermore, a medium detection unit according to this invention fulfills a function to detect a condition of each of media being discharged through a medium conveyance system into a medium discharged section, and comprises a movable member varying in position in accordance with movement of the medium while coming into contact with the medium, and a sensor for sensing a position of the movable member to output a signal indicative of the passage of the medium, a signal indicative of a fully accumulated condition of the media within the medium discharged section and a signal representative of the occurrence of a jam condition of the medium during the passage of the medium.

In this case, it is also appropriate that the movable member is made up of a first member rotatably supported to be rotationally driven in accordance with the movement of the medium while coming into contact with the medium and a second member designed to work on said sensor in conjunction with the rotating movement of the first member to vary the output signal of the sensor at the fully accumulated condition of the media relative to the output signal at the absence of the medium and to vary the output signal of the sensor with both end portions of the medium at the passage of the medium so that this output signal coincides with the output signal at the absence of the medium after being once varied with respect to the output signal at the absence of the medium.

Furthermore, it is also appropriate that the sensor is of an optical transmission type composed of a light-emitting device and a light-receiving device, and the second member of the movable member is made as an interceptor capable of intercepting light between the light-emitting device and the light-receiving device of the optical transmission type sensor.

These arrangements according to this invention can accomplish the size reduction of the unit for detecting the medium discharged condition and can provide the medium detection unit at a low cost, and further permit the control of the operation of an apparatus accompanying the conveyance and discharge operations of the medium in accordance with the detection of the medium discharged condition, with the result that such an apparatus is appropriately controllable.

In addition, with a simple arrangement that only detects the position of one movable member, the detection of success/failure of the discharge of the medium and the fully accumulated condition in the medium discharged section becomes feasible, which can provide a medium detection unit at a low cost.

Moreover, a medium conveyance apparatus according to another aspect of this invention comprises a medium conveyance system for conveying each of media, a medium discharged section for accumulatively receiving the media discharged through the medium conveyance system, a movable member varying in position in accordance with movement of the medium while coming into contact with the medium, and a sensor for sensing a position of the movable member to output a signal indicative of the passage of the medium and the discharge of the medium into the medium discharged section, a signal indicative of a fully accumulated condition of the media within the medium discharged section and a signal representative of the occurrence of a jam condition of the medium during the passage of the medium.

Similarly, in this case, it is also appropriate that the movable member is made up of a first member rotatably supported to be rotatable in accordance with the movement of the medium while coming into contact with the medium and a second member designed to work on said sensor in conjunction with the rotating movement of the first member to vary the output signal of the sensor at the fully accumulated condition of the media relative to the output signal at the absence of the medium and to vary the output signal of the sensor at the passage of the medium so that this output signal coincides with the output signal at the absence of the medium after being once varied with respect to the output signal at the absence of the medium at both end portions of the medium.

Furthermore, it is also appropriate that the sensor is of an optical transmission type composed of a light-emitting device and a light-receiving device, and the second member of the movable member is made as an interceptor capable of intercepting light between the light-emitting device and the light-receiving device of the optical transmission type sensor.

In the above-mentioned medium conveyance apparatus according to this invention, the normally discharged condition of the medium into the medium discharged section, the fully accumulated condition of the media within the medium discharged section and the medium staying condition due to the jam are detectable on the basis of the output signals of the sensor, so that the control of the operation of the medium conveyance apparatus becomes possible in accordance wit the detection of the medium discharged condition, thus ensuring the adequate control of the medium conveyance apparatus. Accordingly, in case that faults such as the jam of the medium and the fully accumulated condition of the media within the apparatus take place, it is possible to take measures against the faults, thus resulting in providing a medium conveyance apparatus with a high reliability.

In addition, with a simple arrangement that only detects the position of one movable member, the detection of success/failure of the discharge of the medium and the fully accumulated condition in the medium discharged section becomes feasible, which can provide a medium detection unit at a low cost.

Still further, in accordance with this invention, there is provided an image formation system comprising a storage section for storing media, an image formation section for transferring an image onto each of the media for image formation, a medium discharged section for accumulating the media each having the image transferred in the image formation section and conveyed thereinto, a medium conveyance system for drawing out each of the media from the storage section and further for discharging the medium into the medium discharged section after passing through the image formation section, a movable member varying in position in accordance with the movement of the medium while coming into contact with the medium, and a sensor for sensing a position of the movable member to output a signal indicative of the passage of the medium and the discharge of the medium into the medium discharged section, a signal indicative of a fully accumulated condition of the media within the medium discharged section and a signal representative of the occurrence of a jam condition of the medium during the passage of the medium.

In this case, it is also advisable that the movable member is made up of a first member rotatably supported to be rotatable in accordance with the movement of the medium while coming into contact with the medium and a second member designed to work on said sensor in conjunction with the rotating movement of the first member to vary the output signal of the sensor at the fully accumulated condition of the media relative to the output signal at the absence of the medium and to vary the output signal of the sensor at the passage of the medium so that this output signal coincides with the output signal at the absence of the medium after being once varied with respect to the output signal at the absence of the medium at both end portions of the medium.

Furthermore, it is also advisable that the sensor is of an optical transmission type composed of a light-emitting device and a light-receiving device, and the second member of the movable member is made as an interceptor capable of intercepting light between the light-emitting device and the light-receiving device of the optical transmission type sensor.

Still further, it is also advisable that the image formation system includes a control section for controlling the operation of the medium conveyance system to stop the discharge of the medium into the medium discharged section when the sensor detects the fact that the medium discharged section is in the fully accumulated condition of the media, or that the image formation system includes a control section for controlling the operations of the medium conveyance system and the image formation section to stop the drawing-out of the media from the storage section and the image formation processing in the image formation section when the sensor detects the fact that the medium discharged section is in the fully accumulated condition of the media.

Thus, the above-mentioned image formation system according to this invention is capable of detecting the normally discharged condition of the medium into the medium discharged section, the fully accumulated condition of the media within the medium discharged section and the medium staying condition due to the jam on the basis of the output signals of the sensor, so that the control of the operation of the image formation system becomes possible in accordance with the detection of the medium discharged condition, thus ensuring the adequate control of the image formation system. Accordingly, in case that faults such as the jam of the medium and the fully accumulated condition of the media within the system take place, it is possible to take measures against the faults, thus resulting in providing an image formation system with a high reliability.

In addition, with a simple arrangement that only detects the position of one movable member, the detection of success/failure of the discharge of the medium and the fully accumulated condition in the medium discharged section becomes feasible, which can provide an image formation system at a low cost.

Moreover, since the control section stops the discharge and drawing-out of the media and the image formation processing in response to the detection of the media reaching the fully accumulated condition, so that the discharge of the medium staying on the way due to the failure into the medium discharged section is inhibited automatically, with the result that less faults occur in the medium discharged section, which signifies that an image formation system with a higher reliability is attainable.

DESCRIPTION OF THE PREFERRED EMBODIMENTS

An embodiment of the present invention will be described hereinbelow with reference to the drawings.

Figure 1:
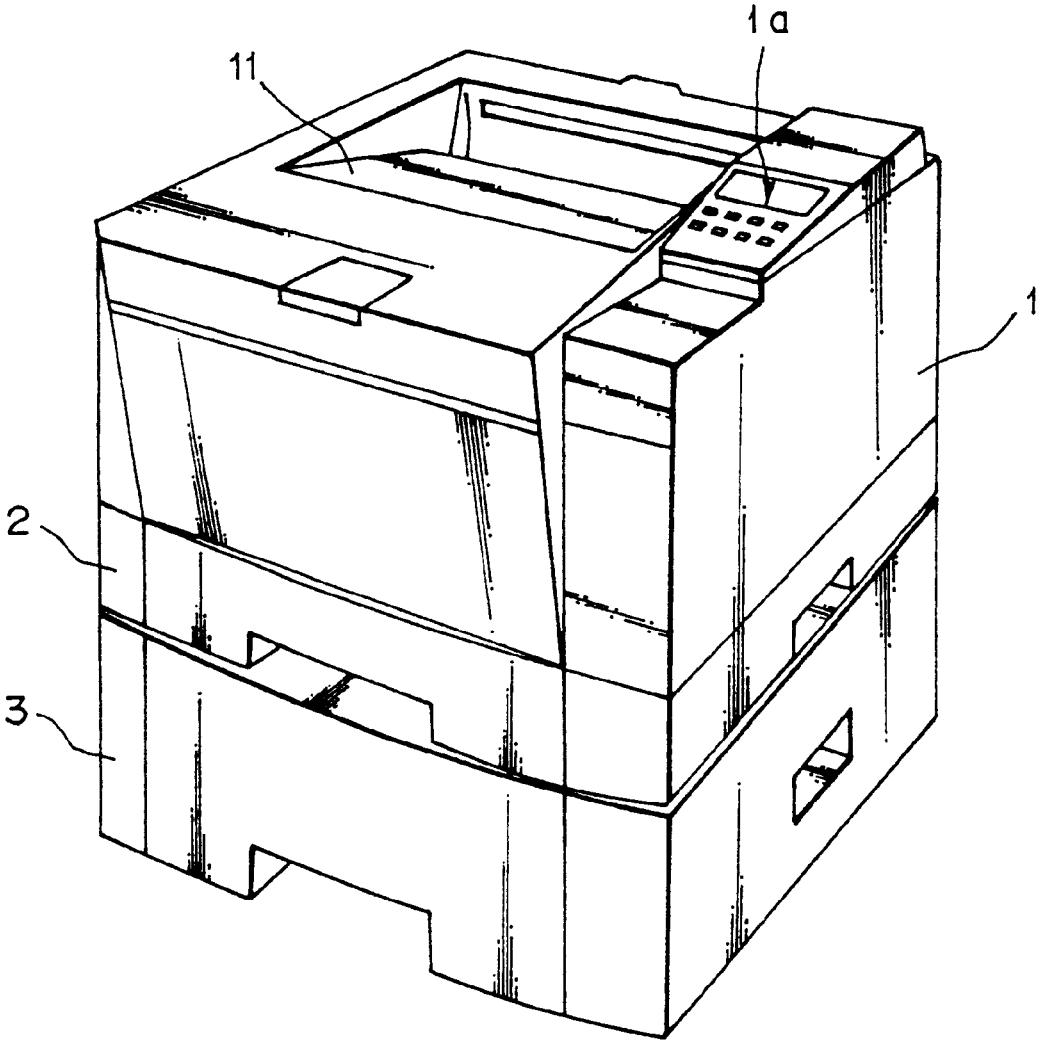
FIG. 1 is a perspective view showing an appearance of a printer system to which the present invention is applicable.

A printer system (image formation system) constituting an embodiment of this invention is, as shown in FIG. 1, provided with a printer body 1 for image formation and paper feeding units (a double-sided print unit 2 and a first paper feeding unit 3) for supplying paper (sheet-like medium, image transferred material) to the printer body 1.

The printer body 1 internally contains various kinds of units and a medium conveyance system for image formation as will be described herein later with reference to FIG. 2 and is, on its upper section, equipped with a stacker (medium discharged section) 11 for receiving the printed (print-completed) paper and for holding them and a control panel 1*a* through which the user operates this printer system. The control panel 1*a* has buttons for various setting and information inputting with respect to the printer system and a display unit not only serving to display the printer operating conditions and the printer setting conditions but also functioning as a touch panel.

Furthermore, the paper feeding units are made to be optionally mounted on the printer unit by the user when necessary, and in the example shown in FIG. 1, as the paper feeding units, there are mounted a double-sided print unit 2 and a first paper feeding unit (storage section) 3 for storing paper (image transferred material) in a piled-up condition. Although the double-sided print unit 2 can serve as a paper feeding unit for storing paper in a piled-up condition, in this embodiment, for the double-sided print to additionally perform the printing on the rear surface of paper, it functions as a mechanism to turn paper upside down and then to supply the paper to the printer body 1. If the user stores paper different in size and type from each other in these paper feeding units 2, 3 in accordance with the applications, the system can widely meet the print requirements from the user because of no need for the replacement of the paper within the paper feeding units on all such occasions. Besides, it is also acceptable to add paper feeding units below the first paper feeding unit 3.

Figure 2:
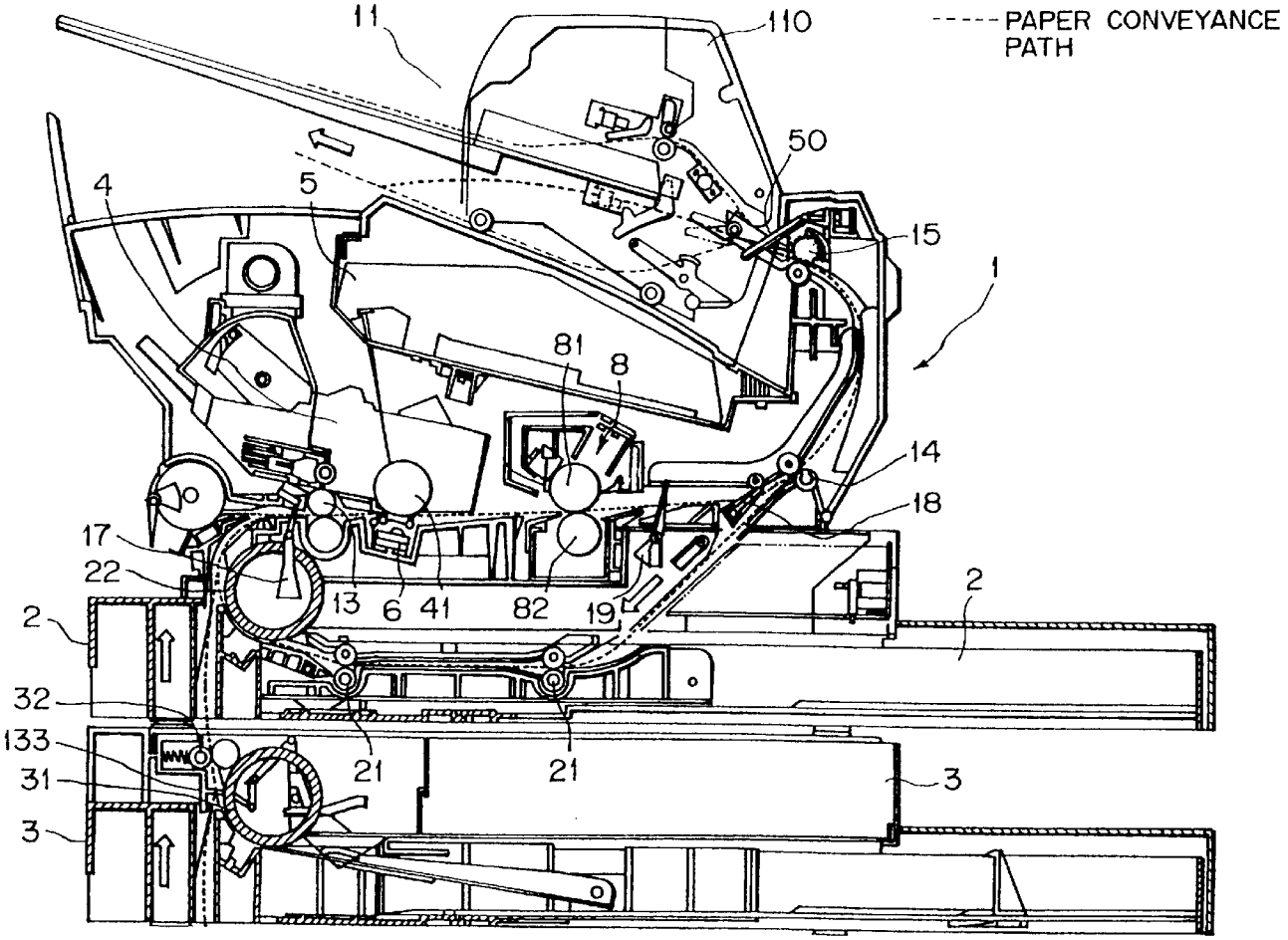
FIG. 2 is a side elevational cross-sectional view showing an internal structure of a printer system according to an embodiment of this invention.

Referring now to FIG. 2, a description will be made hereinbelow of an internal structure of the printer system according to this embodiment.

As shown in FIG. 2, on the paper discharge side of the first paper feeding unit 3, there are provided a pickup roller 31 for one by one drawing out the paper accumulated within the paper feeding unit 3 and feed rollers 32 for upwardly conveying the paper drawn out by the pickup roller 31. As will be described herein later with reference to FIG. 3, the paper feeding unit 3 is additionally provided with a paper size sensor 131, a paper feeding motor 132 and a paper feed sensor 133. Of these components, FIG. 2 illustrates only the paper feed sensor 133 for detecting the paper drawn out from the paper feeding unit 3.

Furthermore, the double-sided print unit 2 includes two sets of double-side feed rollers 21 for conveying paper while holding or sandwiching therebetween so that the paper is turned upside down and fed to the printer body 1, and double-side pickup rollers 22 for forwarding the paper from the double-sided print unit 2. In this instance, when this unit 2 is used as the paper feeding unit, the double-side pickup rollers 22 serves as pickup rollers for drawing out one by one the paper accumulated in the unit.

Still further, the printer body 1 internally incorporates resist rollers 13, a developing unit (print unit) 4, an optical unit 5, a transfer unit 6, a fixing unit 8, first paper discharge rollers 14, second paper discharge rollers 15, a resist sensor 17, a flap gate 18, a paper passage sensor 19, a paper discharge sensor 50, and others. Incidentally, the printer body 1 is internally equipped with a controller 10, a mechanism control section 12 and a power supply section 34 as will be described herein later with reference to FIG. 3.

In this instance, the resist rollers 13 are paired and are for the purpose of conveying paper fed from the first paper feeding unit 3 or the double-sided print unit 2 in a state of sandwiching it therebetween. The resist rollers 13 are rotationally driven (driven to rotate) by a conveyance motor 7 (see FIG. 3). The resist sensor 17 is provided on the upstream side of the resist rollers 13 to sense that the front end (tip) portion of the paper reaches the vicinity of the position at which it is held by the resist rollers 13.

The developing unit 4, in addition to a photosensitive drum 41, contains a developing device, a cleaner section, a destaticizer, an electrifier, and others, which are not shown in FIG. 2. These components of the developing unit 4 are housed in one container to constitute one unit so that these components are replaceable with new ones at a time.

The photosensitive drum 41 is rotationally driven at a constant speed by a drive motor (not shown) while an image to be transferred onto paper is formed on its surface through the electrifier, the optical unit 5 and the developing device. That is, the electrifier is for the purpose of uniformly charging a surface of the photosensitive drum 41, and the optical unit 5 is for exposing the charged surface of the photosensitive drum 41 to form a latent image, and further the developing device is for developing the latent image on the photosensitive drum 41 to form a visible image (toner image). In this embodiment, the motor for rotationally driving the photosensitive drum 41 is also made to rotationally drive rollers 81, 82 of the fixing unit 8, which can lower the manufacturing cost of the system.

The transfer unit 6 is for transferring the toner image formed on the surface of the photosensitive drum 41 onto paper, and is disposed at a position separating from the photosensitive drum 41 by a distance which allows the paper to pass, to be in an opposed relation to the photosensitive drum 41 in a state that a conveyance path through which the paper passes is interposed therebetween. Further, the power supply is put to work on the transfer unit 6 at the time that the paper forwarded by the resist rollers 13 reaches the transfer position, and is controlled to come into the transferable condition.

As the transfer unit 6 there is employed a well-known transferring device using a wire. For such a transferring device, when the paper arrives at the transfer position, through the voltage applied to the wire, the toner image on the surface of the photosensitive drum 41 is sucked from the surface of the paper opposite to the print surface thereof to be attached to the print surface of the paper, so that the toner image on the photosensitive drum 41 is transferred onto the paper. The voltage to be applied to the wire of the transferring device is as high as several thousands volts, and hence, if the power supply to the transferring device is put to work early on, some troubles occur, that is, not only the time period that the power supply works gets long and the power consumption increases, but also the developer remaining on the surface of the photosensitive drum 41 is sucked to the wire to deteriorate the transfer efficiency. For these reasons, it is advisable to apply the voltage to the transfer unit only for the time period of the transfer to the paper.

Furthermore, a transfer method based upon another transferring device is such that a voltage is applied to a roller using a conductive rubber and, as also disclosed in Japanese Unexamined Patent Publication No. 5-346751 (Japanese Patent Application No. 4-156805), paper is put between the roller and a photosensitive drum 41 under pressure so that a toner image on the surface of the photosensitive drum 41 is transferred onto the paper, which is called a roller transferred method.

On the downstream side of the aforesaid transfer unit 6, the fixing unit 8 is located to fix the toner image transferred in the transfer unit 6 onto that paper. This fixing unit 8 is based upon a well-know technique exemplified by Japanese Unexamined Patent Publication No. 1-289988 (Japanese Patent Application No. 63-119878).

This fixing unit 8 is composed of a heating roller 81 and a pressure roller 82.

In this case, the heating roller 8 1 internally has a heat source, and is rotationally driven by a drive motor (not shown; which is the same as the motor for the drive of the photosensitive drum 41).

On the other hand, the pressure roller 82 has a rotary shaft whose both end portions are supported by elastic members (not shown) such as coil springs, so that the pressure roller 82 is pressed against the heating roller 81 at a given pressure caused by their elastic forces (biasing forces). The pressure roller 82 works as a driven roller which rotates in accordance with the rotation of the heating roller 81.

Furthermore, the heating roller 8 1 is disposed to come into contact with the print surface of the paper, and makes the surface temperature of the pressure roller 82 come close to the surface temperature of the heating roller 81 due to the heat carried from the heating roller 81, so that the toner is also heated from the rear surface side of the paper, thus improving the toner fixing efficiency. The widths of the heating roller 81 and the pressure roller 82 are set to be larger than the sizes, i.e., the widths in the conveyance direction [for example, 297 mm in A3 size (one finished paper size according to Japanese Standard Specification)] of the paper treatable in the printer system according to this embodiment. In a manner that paper is put between the aforesaid heating roller 81 and pressure roller 82 and heat and pressure are applied thereto, the toner on the paper is softened so that the toner image is fixed onto the paper.

Provided on the downstream side of the fixing unit 8 are first and second paper discharge rollers 14, 15 for conveying the printed paper while holding to discharge it into the stacker 11, the flap gate 18, and the paper passage sensor 19. Usually, the first and second paper discharge rollers 14, 15 are rotationally driven by a drive motor (not shown) in the direction of sending the paper into the stacker 11. On this contrary, for forwarding the paper into the double-sided print unit 2 in order to turn the paper upside down for the double-sided printing, they is made to be reversely driven.

The flap gate 18 is commonly biased by a spring (not shown) to close the conveyance path from the fixing unit 8 to the stacker 11, and is designed to be put out of the way by the paper sent out of the fixing unit 8 to permit the paper from the fixing unit 8 to pass and, after the rear end of the paper passes there, to return due to the biasing force of the spring to the position of again closing the conveyance path from the fixing unit 8 to the stacker 11. This flap gate 18 exhibits a function to set the conveyance direction of the paper to inhibit the paper from returning to the fixing unit 8 side when sending the paper into the double-sided print unit 2 for the double-sided printing.

The paper passage sensor 19 is placed between the fixing unit 8 and the flap gate 18 to detect the fact that the rear end of the paper passes there, and the detection result of this paper passage sensor 19 is used for the mechanism control section 12 (see FIG. 3) to recognize that the rear end of the paper passes through the flap gate 19. That is, as will be described herein later, the mechanism control section 12 conveys the paper by a given quantity (the value determined from a test or experiment that the paper is actually conveyed) after detecting the rear end of the paper through the use of the paper passage sensor 19, thereby recognizing that the rear end of the paper passes through the flap gate 18.

The stacker 11 of the printer system according to this embodiment is, as shown in FIG. 2, equipped with an option unit 110, and this option unit 110 will be described in structure and operation herein later with reference to FIGS. 3 to 14C.

In this embodiment, the feed roller 32, the double-side feed roller 21, the double-side pickup roller 22, the resist roller 13, the heating roller 81, the pressure roller 82, the first paper discharge roller 14 and the second paper discharge roller 15 function as a medium conveyance system to convey the paper drawn out from the first paper feeding unit 3. Further, the developing unit 4, the optical unit 5, the transfer unit 6 and the fixing unit 8 function as an image formation section to transfer an image onto paper conveyed through the aforesaid medium conveyance system for the image formation.

Moreover, the paper discharge sensor 50 is located in the vicinity of a portion (discharge opening) for discharging the paper from the printer body 1 toward the external and senses the passage of that paper.

Secondly, referring to FIG. 3, a description will be made hereinbelow of an arrangement of a control system of the printer system according to this embodiment.

Figure 3:
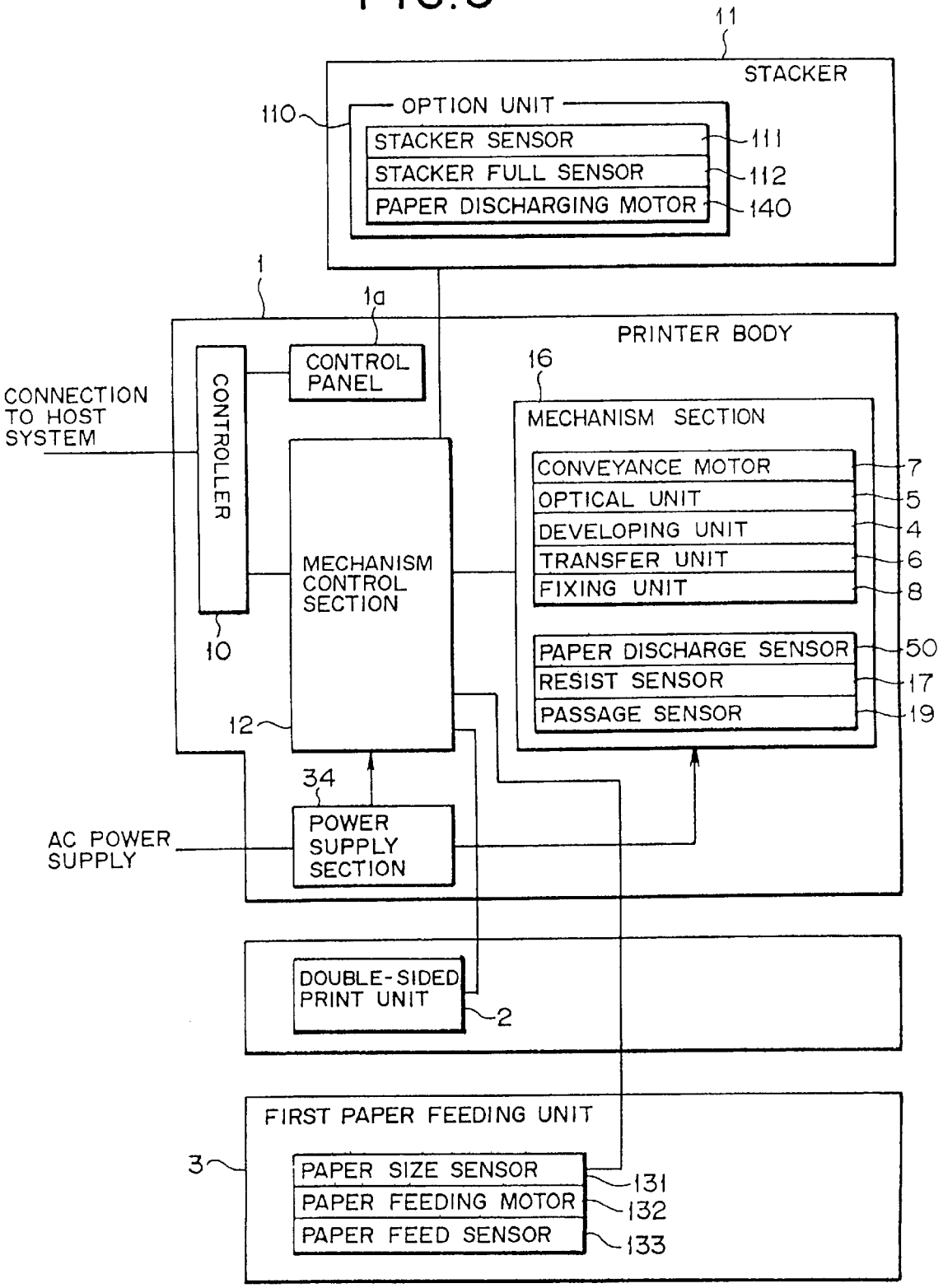
FIG. 3 is a block diagram showing an arrangement of a control system in the printer system according to this embodiment.

As shown in FIG. 3, the first paper feeding unit 3 is equipped with a paper size sensor 131, a paper feeding motor 132, and a paper feed sensor 133. The paper size sensor 131 can accept one disclosed, for example, in Japanese Unexamined Patent Publication No. 64-87431 (Japanese Patent Application No. 62-243621). More specifically, through the use of the means mounted on the first paper feeding unit 3, the system user sets the size of the paper to be placed within the paper feeding unit 3, so that the paper size sensor 131 can detect the size of the paper accommodated within the first paper feeding unit 3. Further, the paper feeding motor 132 is for rotationally driving the pickup roller 31 in the first paper feeding unit 3, whereas the paper feed sensor 133 is, as mentioned before, for detecting the paper fed from the first paper feeding unit 3.

In this embodiment, the printer system is connected through a network such as LAN and a printer cable to a host system (for instance, a personal computer or a server unit). Further, as shown in FIG. 3, in addition to the aforesaid control panel 1*a,* the printer body 1 is provided with the controller 10, the mechanism control section 12, a mechanism section 16, and the power supply section 34.

The controller 10 is made to generally manage the printer system according to this embodiment, that is, executes the control in accordance with the input from the control panel 1*a* and further, when receiving a print request from a host system, develops print data, it gets together with the print request, to fulfill a function to supply it as video data to the mechanism control section 12.

The mechanism section 16 includes not only the developing unit 4, the optical unit 5, the transfer unit 6, the fixing unit 8, the resist sensor 17, the paper passage sensor 19 and the paper discharge sensor 50 mentioned before with reference to FIG. 2, but also the conveyance motor 7 for rotationally driving the resist rollers 13. Although not shown in FIG. 3, other than the components mentioned above, the mechanism section 16 incorporates various mechanisms such as motors for driving the photosensitive drum 41 and the fixing unit 8.

The mechanism control section 12 takes, on the basis of the detection results of the various sensors 17, 19, 131 and 133, the change of control for the operations of the developing unit 4, the optical unit 5, the transfer unit 6, the conveyance motor 7, and the fixing unit 8 in the mechanism section 16 and further for the operation of the paper feeding motor 132 in the first paper feeding unit 3 and even for the operation of a paper discharge motor 140 of the option unit 110, which will be described herein later, thus printing the video data from the controller 10 on paper.

This mechanism control section 12 fulfills various functions, for example if a print request takes place, to decide, on the basis of the detection signal from paper size sensor 131 in the first paper feeding unit 3, whether the size of the paper stored in the first paper feeding unit 3 coincides with the size of the paper corresponding to the print request, and if coinciding with each other, to actuate the paper feeding motor 132 in the first paper feeding unit 3. Incidentally, in case where the printer system is equipped with a plurality of paper feeding units and a plurality of paper having different sizes are stored in these paper feeding units, the mechanism control section 12 selects, on the basis of the detection signal of the paper size sensor 131 in each of the paper feeding units, the paper feeding unit accommodating the paper corresponding to the print request, and puts the paper feeding motor 132 of the selected paper feeding unit into operation.

Furthermore, in this embodiment, the mechanism control section 12 also has a function to control an operation of the printer system, which will be described herein later, on the basis of the detection signals of the option unit 110 mounted on the stacker 11 of the printer body 1 (the output signals of the stacker sensor 111 and the stacker full sensor 112) and the detection result of the paper discharge sensor 50.

The power supply section 34 is coupled to an external AC power source for supply of power to the respective portions in the printer system. Particularly, it supplies a high voltage to the developing unit 4 and the transfer unit 6 which carry out the corona discharge. In addition, the power supply section 34 supplies the power to the conveyance motor 7 in the printer body 1, the paper feeding motor 132 of the first paper feeding unit 3 and the paper discharge motor 140 of the option unit 110.

Secondly, referring to FIG. 2, a description will be taken hereinbelow of the basic operation of the printer system thus arranged according to this embodiment.

In putting paper into print in the printer system, as shown in FIG. 2, the pickup roller 31 draws out one by one paper accumulated within the first paper feeding unit 3. This paper is conveyed upwardly while being held between the feed rollers 32, and further carried while being held between the resist rollers 13 so that the toner image formed in the developing unit 4 is transferred onto the same paper in the transfer unit 6. The paper with the toner image transferred is forwarded to the fixing unit 8 where the toner image is fixed on the paper by means of heat and pressure. Further, the paper after the fixing is conveyed through the first paper discharge rollers 14 and the second paper discharge rollers 15 to be discharged into the stacker 11 (onto an accumulating section 51 of the stacker 11 or a stacker bin 113 of the option unit 110 which will be mentioned later) and stored therein in an accumulated condition. In the above-mentioned printing operation according to this embodiment, an image is formed in accordance with a well-known image formation procedure disclosed, for instance, in Japanese Unexamined Patent Publication No. 1-98529 (Japanese Patent Application No. 62-252524), thus accomplishing the printing on the paper.

As mentioned before, the mechanism control section 12 (see FIG. 3) puts the paper feeding motor 132 of the first paper feeding unit 3 into operation to rotationally drive the pickup roller 31 in the case that the paper corresponding to the print request is stored in the paper feeding unit 3.

The paper feeding motor 132 of the first paper feeding unit 3 is put into operation to rotationally drive the pickup roller 31, thus initiating the pickup operation. With the rotation of the pickup roller 31 and the feed rollers 32 in the paper conveyance direction, the paper accommodated within the first paper feeding unit 3 is drawn out by one and then sent upwardly. The decision on whether or not the paper is drawn out from the first paper feeding unit 3 is made on the basis of the detection result of the paper feed sensor 133. More specifically, if no detection of the paper arises by the paper feed sensor 133 regardless of the rotation of the pickup roller 31 by a given quantity, the mechanism control section 12 makes a decision to that the paper is not normally drawn out therefrom, and temporarily stops the draw-out of the paper and then again carries out the draw-out operation. On the other hand, if the paper feed sensor 133 detects the paper until the pickup roller 31 rotates by the given quantity, the mechanism control section 32 makes a decision to the normal draw-out of the paper therefrom, and hence, continue the conveyance of the paper.

Furthermore, the resist sensor 17 detects the front end portion of the paper coming through the pickup roller 31 and the feed rollers 32, and subsequently, continues the conveyance of the paper by a quantity predetermined through a test. The mechanism control section 12 operates the paper feeding motor 132 by the corresponding set quantity to convey the paper, thereafter stopping the paper feeding motor 132. Whereupon, the front end portion of the paper is brought into contact with the resist rollers 13 to correct an inclined condition of the paper. At this step, the pickup of the paper from the first paper feeding unit 3 comes to completion.

In response to the stop of the paper feeding motor 132, the mechanism control section 12 immediately operates the conveyance motor 7 to rotationally drive the resist rollers 13 to start the conveyance of the paper by the resist rollers 13.

Following this, the paper is conveyed by the resist rollers 13 to the transfer unit 6 where the toner image formed on the surface of the photosensitive drum 41 is transferred onto the paper, and subsequently, the paper is further conveyed by the resist rollers 13 to the fixing unit 8. In the fixing unit 8, the paper is interposed between the heating roller 81 and the pressure roller 82 so that the toner is softened and the toner image is fixed onto the paper owing to the heat and pressure. The paper subjected to the fixing processing in the fixing unit 8 advances to put the flap gate 18 out of the way. In the case of the one-sided print, after passing through the flap gate 18, the paper is discharged into the stacker 11 by means of the first and second paper discharge rollers 14, 15 to be stored there in an accumulated condition.

In the case of the double-sided print, after the print on the front surface of the paper is done in accordance with the same printing operation as that for the one-sided print, the paper is conveyed through the paper discharge rollers 14, 15 until the rear end thereof passes through the flap gate 18. The mechanism control section 12 detects the rear end of the paper through the use of the paper passage sensor 19 and then recognizes the passing of the rear end of the paper through the flap gate 18 in a manner of conveying the paper by a given quantity (a value determined through a test of actually conveying paper), and reversely drives the paper discharge rollers 14, 15 at the moment of recognizing that the rear end of the paper passes through the flap gate 18. Consequently, the paper conveyed in the opposite direction passes under the flap gate 18 and goes to the double-sided print unit 2, and then is again conveyed to the upstream side of the resist rollers 13 by the double-side feed rollers 21 and the double-side pickup rollers 22. The same printing operation as that in the aforesaid one-sided print is conducted with respect to the paper thus turned upside down, so that the rear surface of the paper is put into print. After the completion of the printing operation for the rear surface, the paper is discharged into the stacker 11 by the paper discharge rollers 14, 15 to be stored in an accumulated condition after the fixing processing is conducted in the fixing unit 8 in a similar way.

When a printer system is in connection with a network, this printer system is used in common with a plurality of client systems such as personal computers connected to the same network. Naturally, the print requests to the printer system extremely frequently take place.

In the stacker 11 of the printer system, the paper discharged through the second paper discharge roller 15 is accumulated by gravity. Accordingly, an excessively long paper free-fall distance raises the possibility that the paper scathingly drops. For this reason, the stacker 11 is designed to accept approximately 300 pieces of paper. Assuming that the print speed of the printer system is approximately 20 pieces/minute, the print to 300 pieces of paper becomes possible for 20 minutes, which signifies that the stacker 11 reaches the full condition unless the printed paper are extracted in the meantime.

In the case of the printer system shown in FIG. 2, the print for paper of a maximum of A3 size (420 mm in length by 297 in width) is possible. On the other hand, for effectively making the printing for the paper of A4 size (297 mm in length by 210 mm in width), the paper is conveyed in a state where the long side of the paper is perpendicular to the conveying direction so that the length of the paper in its feeding direction comes to 210 mm. Both the A3 and A4 are finished paper size according to the Japanese Standard Specification.

Accordingly, the distance of the conveyance path from the paper supply section of the first paper feeding unit 3 (the paper supply position of the pickup roller 31) up to the stacker 11 reaches approximately 410 mm, which is longer than 210 mm constituting the width of the A4 size paper, so that the concurrent conveyance of a plurality of paper becomes feasible. In other words, in a manner that, before one printed paper is discharged into the stacker 11, the next paper is drawn out from the first paper feeding unit 3, the print speed becomes high so that the number of paper to be put into print for a given period of time increases.

However, in case that failure of discharge of the paper arises during the aforesaid paper conveyance, except that the printing process interrupts, there is a probability that the paper already drawn out from the first paper feeding unit 3 runs into the paper causing the discharge failure to make the discharge failure worse.

For this reason, it is necessary to manage the condition of the paper to be discharged and stored in the stacker 11, and to control the operation of the entire printing system.

In addition, as mentioned before, in general the printer system is remote from the client system issuing a print request to that printer system. Accordingly, it is desirable that the printer system itself can manage its own condition such as the stacker full condition without depending upon a manual operation by the operator or the like of the client system.

Thus, in this embodiment, for the purpose of separating and storing the printed paper according to the applications or the like or of increasing the number of paper storable within the stacker 11, as shown in FIG. 2, the option unit 110 is mounted on the stacker 11 of the printer system.

Figure 4:
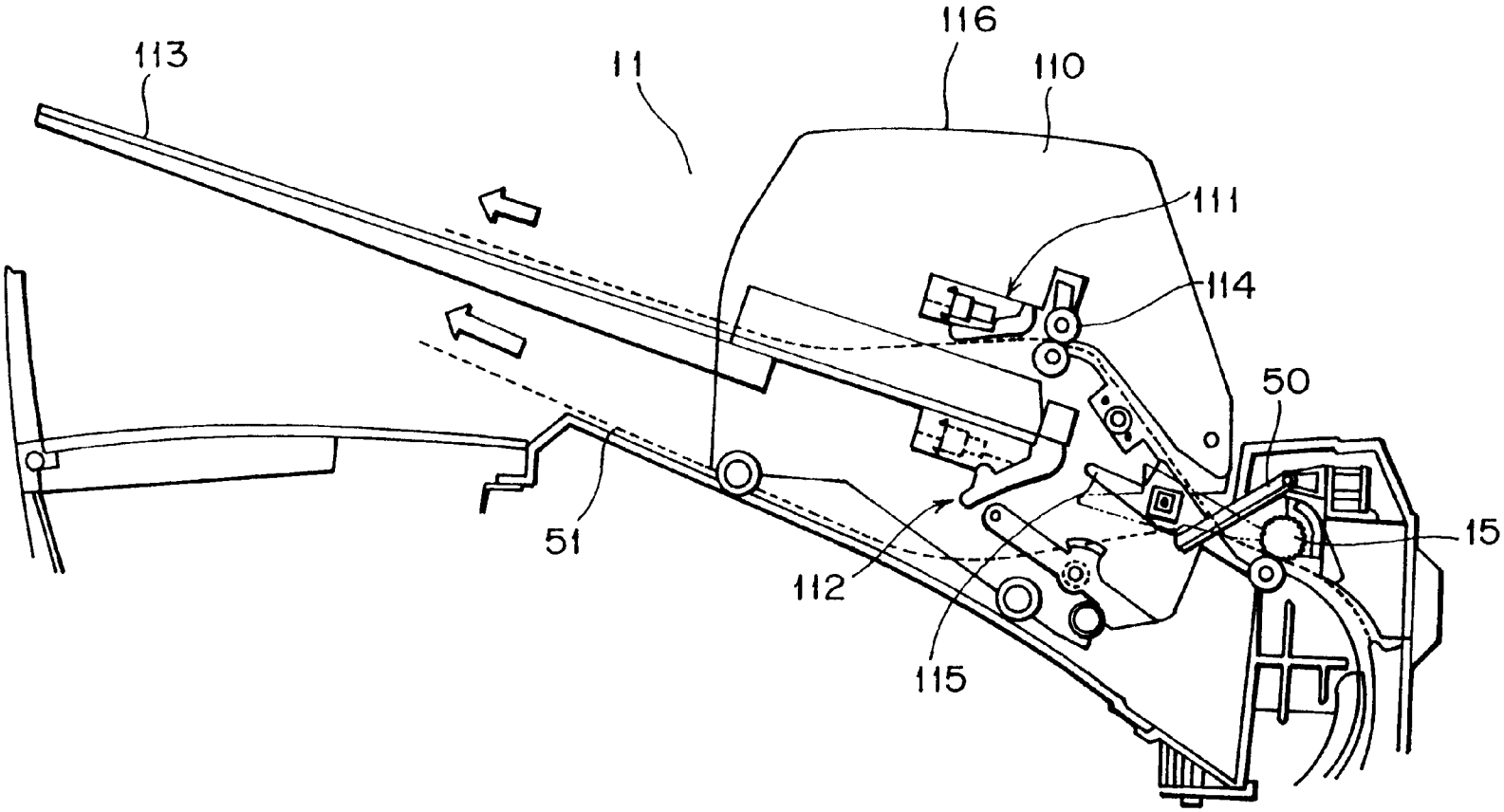
FIG. 4 is a side elevational cross-sectional view showing detailed structures of a stacker and an option unit in the printer system according to this embodiment.

As shown in FIG. 4, this option unit 110 is composed of a stacker bin (medium discharged section) 113 for piling up paper therein, a third paper discharging roller(s) 114 rotationally driven by the paper discharging motor 140 (see FIG. 3) for discharging the paper, a stacker sensor 111 for detecting the condition of the paper to be discharged onto the stacker bin 113, a stacker full sensor 112 for detecting the fact that the paper discharged onto an accumulating section 51 of the stacker 11 reaches the full condition, and a sorting gate 115 for distributing the paper discharged from the printer body 1 side onto the accumulating section 51 of the stacker 11 or onto the stacker bin 113.

A detailed description of a structure and operation of the stacker full sensor 112 will be made herein later with reference to FIGS. 6 to 9, and further a detailed description of an structure and operation of the stacker sensor 111 will be taken herein later with reference to FIGS. 10 to 14C.

As shown in FIG. 3, the option unit 110 is coupled through a connector (not shown) and a cable (not shown) to the printer body 1. Whereupon, the mechanism control section 12 of the printer body 1 controls the paper discharging motor 140 acting to rotationally drive the third paper discharging roller 114 and the position of the sorting gate 115 and further receives the detection signals from the stacker sensor 111 and the stacker full sensor 112. The stacker sensor 111 is covered with an upper cover 116 of the option unit 110 to be directly invisible from the external.

Although in the description of this embodiment the option unit 110 is provided with only one stacker bin 113, it is also advisable to provide a plurality of stacker bins 113 for the purpose of increasing the amount of paper to be stored in a piled-up condition or of achieving a finer assortment. In this case, it is necessary to additionally provide a conveyance path to each of the respective stacker bins 113 and a sorting gate for sorting the paper to each of the conveyance paths.

A paper discharge control operation in the printer system with the above-described option unit 110, taken for the paper discharge into the stacker 11, will be described hereinbelow according to the flow chart of FIG. 5.

The mechanism control section 12 carries out the printing on paper on the basis of print data coming through the controller 10 from a host system (step S1).

The decision as to whether the paper is to be discharged into the stacker 11 (that is, the accumulating section 51) or the stacker bin 113 depends upon instructions from the host system or the condition of the system, and accordingly the mechanism control section 12 rotationally positions the sorting gate 115 to choose the corresponding paper conveyance path (step S2).

The paper after the fixing processing in the fixing unit 8 is conveyed by the first paper discharge rollers 14 and further conveyed by the second paper discharge rollers 15 toward the stacker 11 (step S3).

In response to the detection by the paper discharge sensor 50 ("YES" route in step S4), the paper discharge rollers 14, 15 further advance the paper. In the case that the paper discharge sensor 50 does not detect the paper in spite of the conveyance continuing for a given period of time after a paper detection sensor (not shown) existing on the upstream side of the paper discharge sensor 50 detects the paper conveyance ("NO' route in step S4 and "YES" route in step S5), the mechanism control section 12 makes a decision that a paper jam occurs in front of the paper discharge sensor 50, and hence, stops the printer system and informs the user of this paper jam (step S6).

Even after the paper discharge sensor 50 detects the paper (the presence of the paper), the paper discharge rollers 14, 15 continue the paper conveyance. Meanwhile, the mechanism control section 12 monitors the detection result of the paper discharge sensor 50 (step S7), and if the paper discharge sensor 50 detects the front end of the paper, the mechanism control section 12 checks whether or not a given period of time previously set from the paper size passes after that detection (from "YES" route in step S7 to step S8).

In this case, the given period of time serving as the standard or criterion of decision in the step S8 is a time period from a point of time that the front end of the paper reaches the position of the paper discharge sensor 50 (the time that the paper discharge sensor 50 detects the front end of the paper) to a point of time that the rear end of the paper passes by the position of the paper discharge sensor 50 (the time that the paper discharge sensor 50 comes to no detection of the paper) in case where the paper conveyance ordinarily takes place.

Furthermore, if the decision is made in step S8 to that the given time period elapses ("YES" route), the mechanism control section 12 makes a decision to that a paper jam occurs in front of the paper discharge sensor 50, and hence, stops the operation of the printer system and informs the user of the printer system of it (step S9).

In case where in step S2 the sorting gate 115 is positioned to convey the paper toward the accumulating section 51 side, the paper coming from the second paper discharge roller 15 is discharged onto the accumulating section 51 (originally, an upper surface of the printer body 1 for storing paper in an accumulated condition) of the stacker 11.

At this time, after the paper detection by the stacker full sensor 112 ("YES" route in step S10), the mechanism control section 12 monitors whether or not the given period of time predetermined from the paper size elapses (step S11).

In this case, the given period of time serving as the standard of decision in the step S11 is a time period from a point of time that the front end of the paper reaches the position of the stacker full sensor 112 (the time that the stacker full sensor 112 detects the front end of the paper) to a point of time that the rear end of the paper passes by the position of the stacker full sensor 112 (the time that the stacker full sensor 112 comes to no detection of the paper) in case where the paper conveyance ordinarily takes place.

Still further, when the decision is made in the step S11 to that the given period of time elapses ("YES" route), the detection result of the stacker full sensor 112 is again confirmed (step S12).

In the case that the stacker full sensor 112 does not detect the paper ("NO" route in step S10) or in the case that the given period of time does not elapse yet although the stacker full sensor 112 detects the paper ("YES" route in step S10 and "NO" route in step S11), the mechanism control section 12 continues to monitor the detection signals of the paper discharge sensor 50 and the stacker full sensor 112 (steps S7 to S10).

In the case that in the step S12 the stacker full sensor 112 detects no paper ("NO" route), the mechanism control section 12 makes a decision to that the paper normally passes to be discharged and accumulated in the accumulating section 51 (step S13), and continues to conduct the printing processing (step S1).

If in the step S 12 the stacker full sensor 112 detects the paper ("YES" route), the mechanism control section 12 makes a decision to that the paper reaches the full condition within the accumulating section 51, and hence, executes the stacker full processing (steps S14 to S16).

More specifically, the mechanism control section 12 stops the supply of the paper from the first paper feeding unit 3 (step S14) and checks whether or not there is the paper already drawn out from the first paper feeding unit 3 (step S15). If so ("YES" route in step S15), the mechanism control section 12 performs the printing processing to that paper and discharges it into the accumulating section 51.

In this operation, if the paper drawn out from the first paper feeding unit 3 disappears on the conveyance path in the printer system before the detection of the stack full condition ("NO" route in step S15), the mechanism control section 12 stops the paper feeding motor 131, the conveyance motor 7, the developing unit 4, the optical unit 6, the transfer unit 7 and the fixing unit 8 and conducts the stopping processing for the printer system (step S16), and subsequently gives to the user an alarm indicative of the fact that the stacker 11 (the accumulating section 51) is in the full condition.

On the other hand, if in the step S15 the decision shows that no paper drawn out from the first paper feeding unit 3 exists within the printer system from the start ("NO" route), immediately the printer system undergoes the stopping processing and an alarm to the effect that the stacker 11 is in the full condition is issued toward the user of the printer system.

In the case of the printer system according to this embodiment, in the case that the A4 size paper is conveyed in the transverse direction, three pieces of paper momentarily stay on the paper conveyance path extending from the first paper feeding unit 3 up to the stacker 11, and therefore, it is necessary that the detection of the full condition of the accumulating section 51 be made in a state where there is a room for further accepting two pieces of paper after the stacker full sensor 112 detects the full condition of the accumulating section 51.

In case where the conveyance path of the printer system is prolonged to increase the number of paper concurrently existing on the conveyance path, the full condition is necessary to detect in a state where the further accumulation of this number of paper in the accumulation section 51 is possible after the detection of the full condition of the accumulating section 51.

Referring to FIGS. 6 to 9, a detailed description will be made hereinbelow of the stacker full sensor 112.

Figure 6:
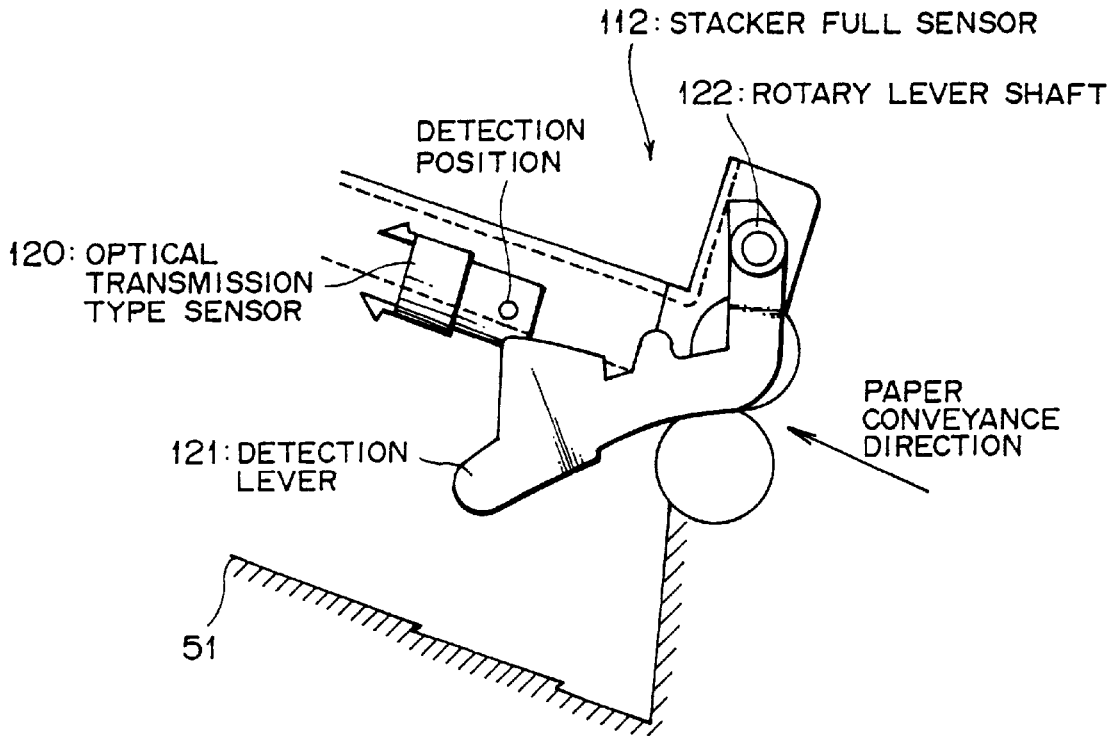
FIG. 6 is a side elevational view showing a stacker full sensor in this embodiment.

The stacker full sensor 112 is, as shown in FIG. 6, composed of a detection lever 121, a rotary lever shaft 122 and an optical transmission type sensor 120.

The detection lever 121 is set through the rotary lever shaft 122 to a system casing (a casing for the option unit 110) to be rotatable. This detection lever 121 undergoes a limitation not to further rotate in the direction of the bottom surface of the accumulating section 51 in an ordinary condition.

The optical transmission type sensor 120 is fixedly secured to the system casing (the case of the option unit 110). At the detection position of this optical transmission type sensor 120, a light-emitting device and a light-receiving device are placed in an opposed relation to each other, and the detection lever 121 rotated in accordance with the discharged condition of the paper intervenes between the light-emitting device and the light-receiving device to intercept the light between these devices.

Figure 7A:
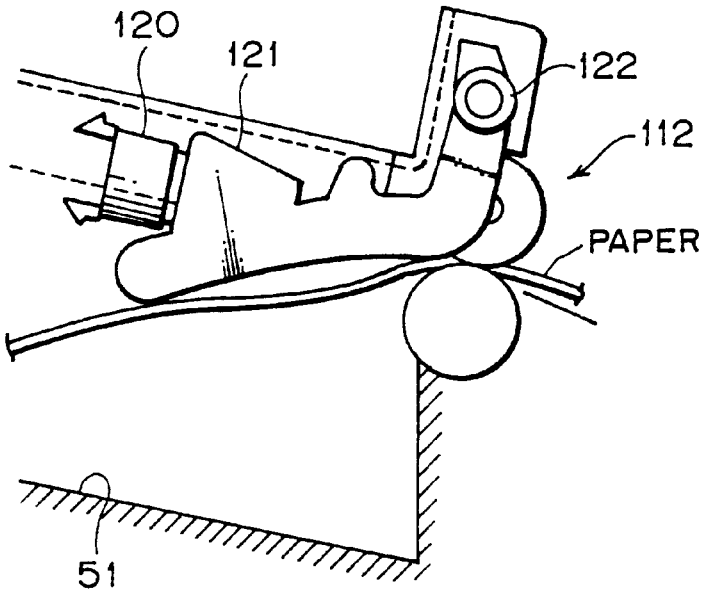
FIGS. 7A and 7B are illustrations useful for explaining an operation (operation to be taken for when paper normally passes) of the stacker full sensor in this embodiment.
Figure 7B:
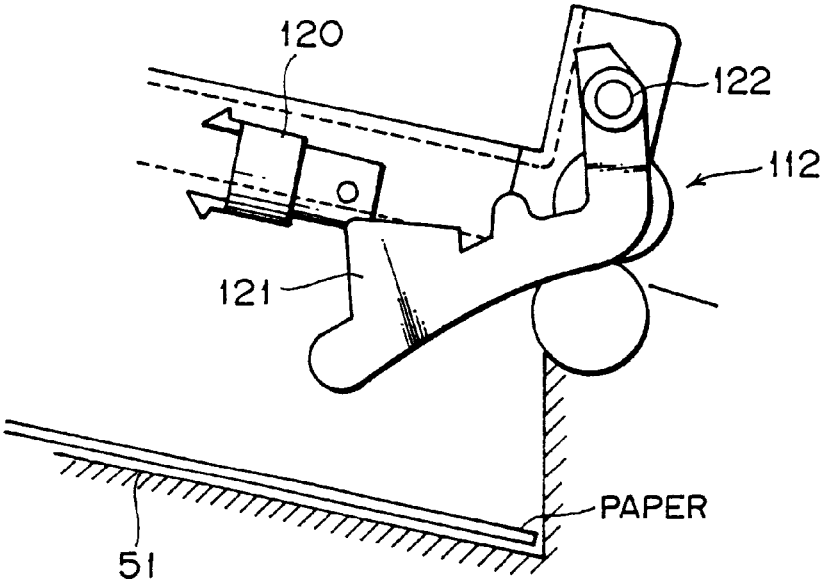

In the case that the paper is conveyed from the right side in FIG. 6, with this movement of the paper, the detection lever 121 rotates. While the paper passes through the position of the detection lever 121, the detection lever 121 comes into contact with the paper to rotate up to the position shown in FIG. 7A to cut in the detection position of the optical transmission type sensor 120, which accomplishes the detection of the fact that the paper is on passage at the position of the optical transmission type sensor 120. Thereafter, when the paper is discharged into the accumulating section 51 to be piled up therein as shown in FIG. 7B, the detection lever 121 returns to its original position due to its self-weight to make the detection position of the optical transmission type sensor 120 open.

Figure 9A:
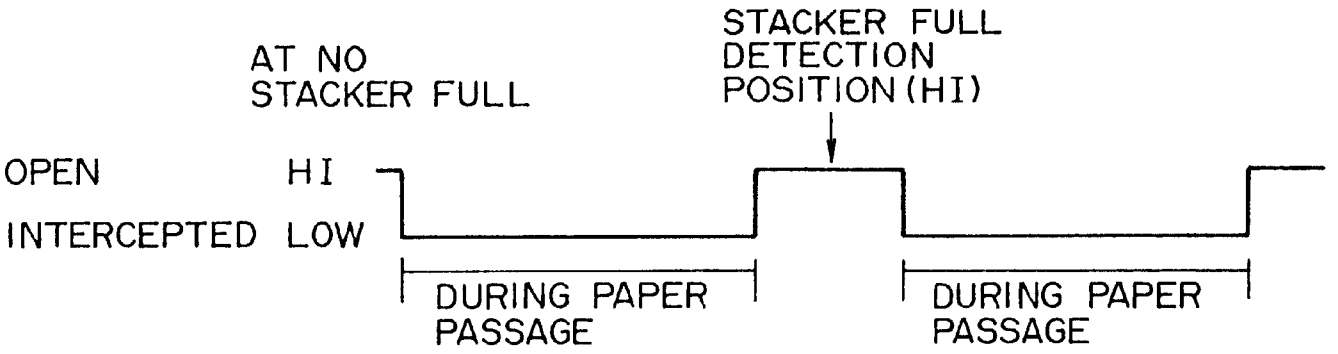
FIGS. 9A and 9B are illustrations of output examples of detection signals from the stacker full sensor for describing the operations of the stacker full sensor in this embodiment.

A brief description is to say that, in case where the accumulating section 51 is not in the full condition and the paper normally passes through the position of the stacker full sensor 112, the stacker full sensor 112 outputs such an output signal as shown in FIG. 9A.

Usually, the optical transmission type sensor 120 is in the open condition (non-intercepted condition), the output signal of the optical transmission type sensor 120 assumes a high-level condition. On the other hand, when the paper passes through the position of the stacker full sensor 112, the detection lever 121 intercepts the light of the optical transmission type sensor 120, so that its output signal goes low.

After the paper passes through the position of the optical transmission type sensor 120, the optical transmission type sensor 120 again returns to the open condition, with the result that its output signal comes into the high-level condition.

When receiving the above-mentioned output signal from the stacker full sensor 112 (optical transmission type sensor 120), the mechanism control section 12 recognizes the fact that the paper normally passes through the position of the stacker full sensor 112 to be discharged onto the accumulating section 51.

Figure 8A:
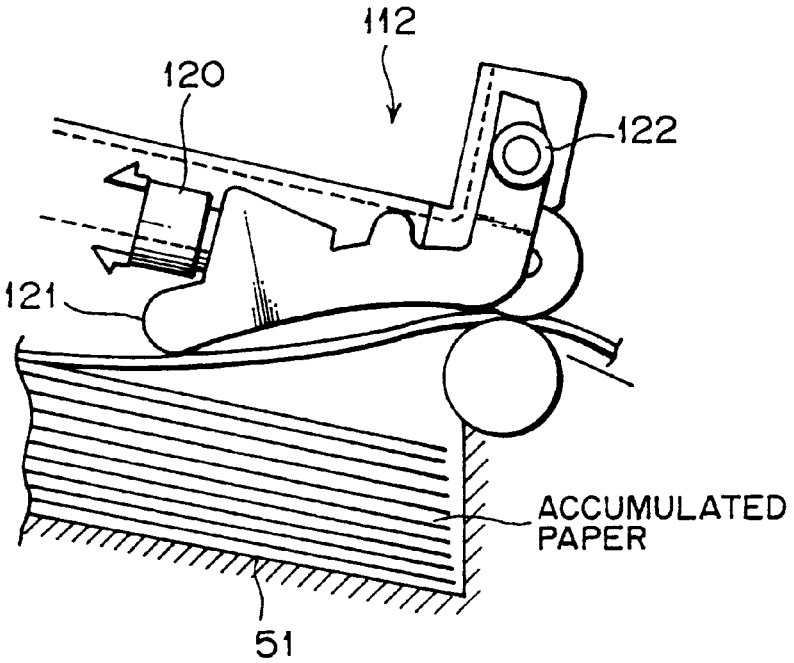
FIGS. 8A and 8B are illustrations useful for explaining an operation (operation to be taken for when the stacker reaches the paper full condition) of the stacker full sensor in this embodiment.
Figure 8B:
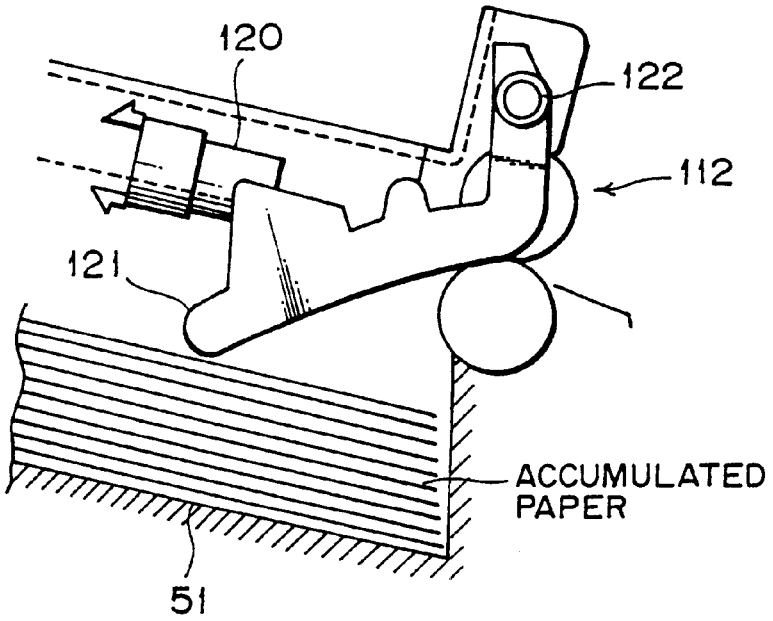
Figure 9B:
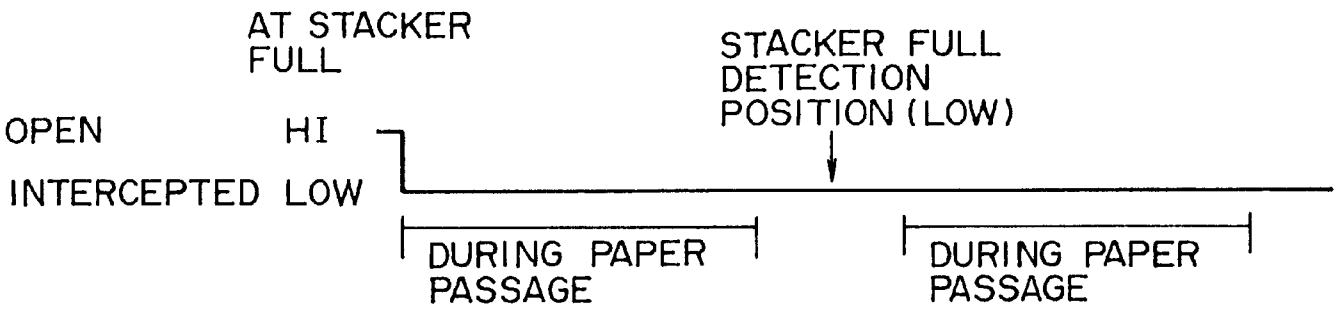

When a plurality of paper normally pass through the position of the stacker full sensor 112 and are accumulated in the accumulating section 51 which in turn, comes into the full condition, the detection lever 121 of the stacker full sensor 112 intercepts the light of the optical transmission type sensor 120 due to the paper conveyance as shown in FIG. 8A. Accordingly, the output signal of the stacker full sensor 112 (that is, the output signal of the optical transmission type sensor 120) varies from the high level to the low level as shown in FIG. 9B. When reaching the stacker full condition at the time that the paper is stored in the accumulating section 51, the detection lever 121 stops in the condition shown in FIG. 8B, and hence, the output signal of the optical transmission type sensor 120 remains to be in the low level condition. Thus, the mechanism control section 12 is made to recognize that the accumulating section 51 is in the full condition, at the time of confirming that a given period of time elapses after the output signal of the stacker full sensor 112 comes to the low level.

In the case of use of this type of stacker full sensor 112, if the paper stops at the stacker full sensor 112 because of a jam, the detection lever 121 freezes in the condition shown in FIG. 8A, thus resulting in providing the same signal as that shown in FIG. 9B. If based upon this stacker full sensor 112, difficulty is encountered to detect the paper jam except the detection of the full condition of the accumulating section 51 and the normal passage of the paper. For this reason, in the case that the paper is already drawn out from the first paper feeding unit 3, the paper is put into print and conveyed regardless of the occurrence of a paper jam, with the result that the jam condition can be made worse.

Thus, for the detection, it is necessary to distinguish between the stacker full condition and the paper jam condition. In this embodiment, although not shown in FIG. 5, the distinction between the stacker full condition and the paper jam condition is made on the AND condition of the output signal of the stacker full sensor 112 and the output signal of the paper discharge sensor 50.

More specifically, in the case that the paper stop at the stacker full sensor 112 because of a jam, the detection lever 121 stops in the condition shown in FIG. 8A. At this time, since the paper discharge sensor 50 also outputs a signal indicative of the detection of the paper, it is found that the paper is in the jam condition. Even when reaching the full condition, the detection lever 121 of the stacker full sensor 112 likewise stops in the condition shown in FIG. 8A. However, in this case, the paper discharge sensor 50 issues a signal representative of no detection of the paper, so that the occurrence of the stacker full condition is detectable. Thus, the distinction between the stacker full condition and the jam condition is made in the mechanism control section 12 on the basis of the output signal of the stacker full sensor 112 and the output signal of the paper discharge sensor 50.

On the other hand, particularly, in the case of the installation of the option unit 110, since the distance from the paper discharge sensor 50 located on the printer body 1 side to the stacker sensor 111 is extended, difficulty is encountered to distinguish between the stacker full condition and the paper jam condition under the AND condition of the output signals of the stacker sensor 111 and the paper discharge sensor 50.

If another sensor is provided in order to distinguish between the jam condition and the stacker full condition and further to detect one of them, the cost would come to rise accordingly, and hence, such a sensor addition is undesirable.

Thus, in this embodiment, the option unit 110 is equipped with the stacker sensor 111 constituting a structural feature of this invention, which is made to be capable of detecting the stacker full, paper passage and paper jam conditions by itself.

The stacker sensor 111 of this embodiment will be described hereinbelow with reference to FIGS. 10 to 14C.

Figure 10:
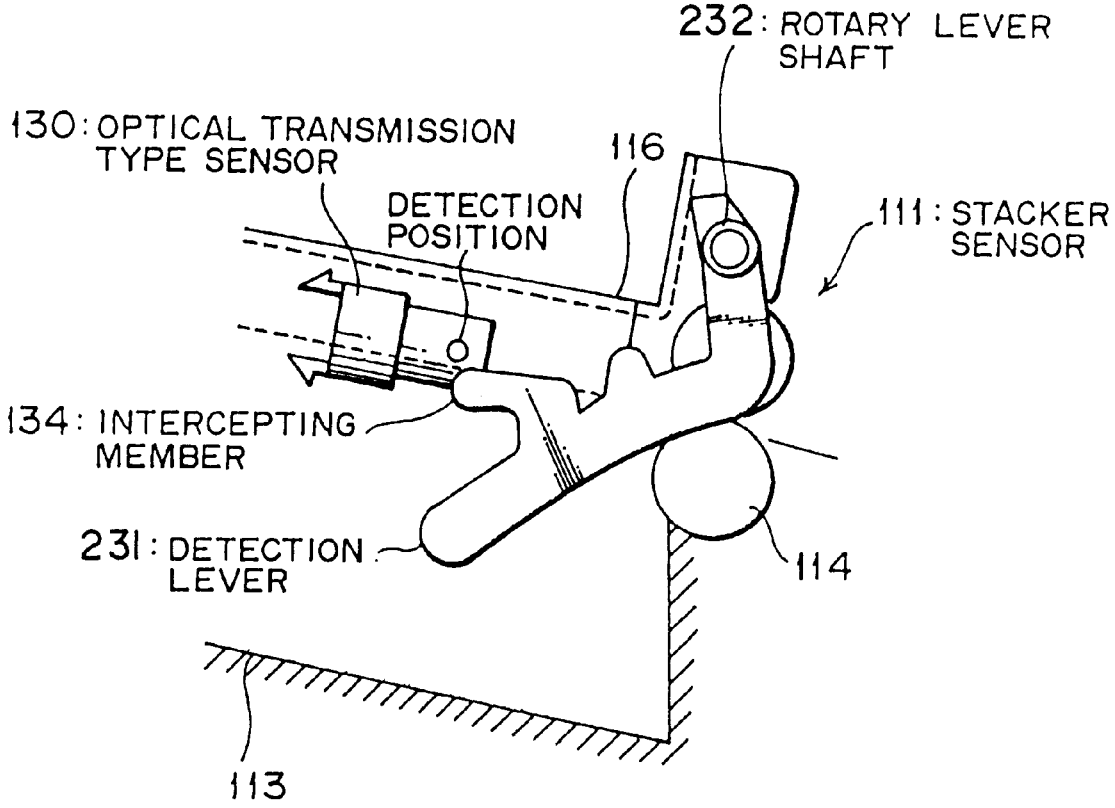
FIG. 10 is a side elevational view showing a stacker sensor in this embodiment.

The stacker sensor 111 is, as shown in FIG. 10, composed of a detection lever 231, a rotary lever shaft 232, an optical transmission type sensor 130 and an intercepting member 134.

The detection lever (first member) 231 and the intercepting member (second member) 134 organize a movable member varying in position in accordance with the movement of the paper while being brought into contact with the paper.

The detection lever 231 is born by the system casing (the casing of the option unit 110) to be rotatable around the rotary lever shaft 232 so that it is allowed to rotationally move in accordance with the movement of the paper in a state of coming into contact with the paper. This detection lever 231 is limited not to further rotationally move in the direction of the bottom surface of the stacker bin 113 in the ordinary state.

The intercepting member 134 is formed integrally with the detection lever 231 to protrude therefrom, and works on the optical transmission type sensor 130 as will be described later in conjunction with the rotational movement of the detection lever 231.

The optical transmission type sensor 130 is fixedly secured to the system casing (the casing of the option unit 110). At the detection position of this optical transmission type sensor 130, its light-emitting and light-receiving devices are placed in an opposed relation to each other. The intercepting member 134 of the detection lever 231 rotationally shifted according to the paper discharge condition cuts in between the light-emitting and light-receiving devices to block the light passage therebetween.

When sensing the position of the intercepting member 134, the optical transmission type sensor 130 outputs a signal indicative of the fact that the paper passes and is discharged into the stacker bin 113, a signal indicative of that the paper reaches its fully accumulated condition in the stacker bin 113, and a signal representative of that the paper comes into its jam condition during the passage.

In case where the paper is conveyed from the right-hand side in FIG. 10, the detection lever 231 rotationally moves to the movement of that paper. At the time when the front end portion of the paper arrives at the position of the detection lever 231, the detection lever 231 comes into touch with the paper and rotationally moves up to the position shown in FIG. 11A, and the detection of the fact that the front end portion of the paper reaches the position of the optical transmission type sensor 130 is achievable on the basis of the fact that, after the intercepting member 134 once cuts in the detection position of the optical transmission type sensor 130, the optical transmission type sensor 130 again gets into its open (non-intercepted) condition. While the paper passes through the position of the detection lever 231, the optical transmission type sensor 130 is in the open condition.

Figure 11A:
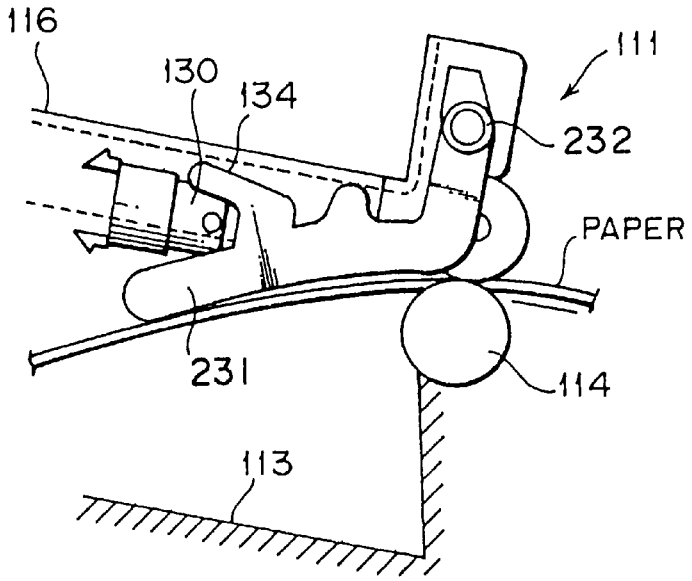
FIGS. 11A and 11B are illustrations useful for explaining an operation (operation to be taken for when paper normally passes) of the stacker sensor in this embodiment.
Figure 11B:
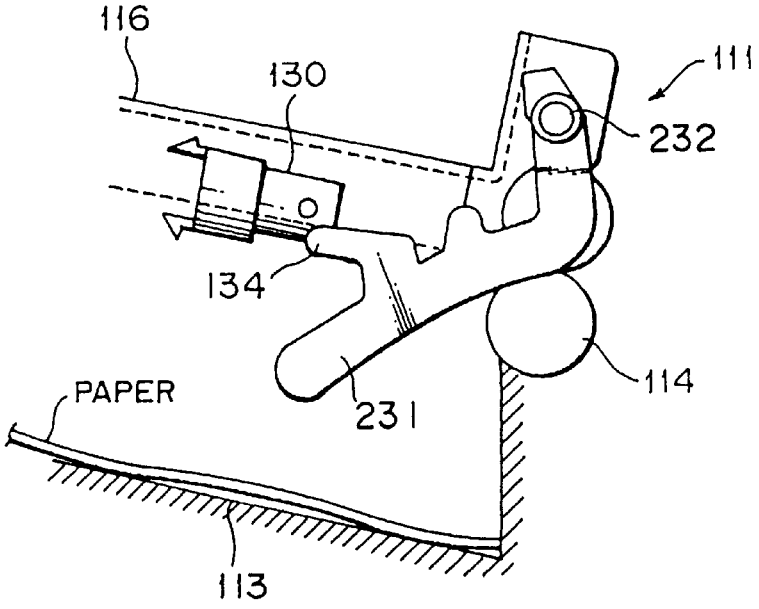

Furthermore, when the paper is discharged to be accumulated in the stacker bin 113 as shown in FIG. 11B, the detection lever 231 rotates to return from the FIG. 11A condition to the FIG. 11B condition by its self-weight in accordance with the rear end portion of the paper passing through the position of the detection lever 231. Whereupon the intercepting member 134 once comes in the detection position of the optical transmission type sensor 130 for the interception, and subsequently, the optical transmission type sensor 130 again gets into its open condition, which allows the detection of the passage of the rear end portion of the paper through the position of the optical transmission type sensor 130.

Figure 13A:
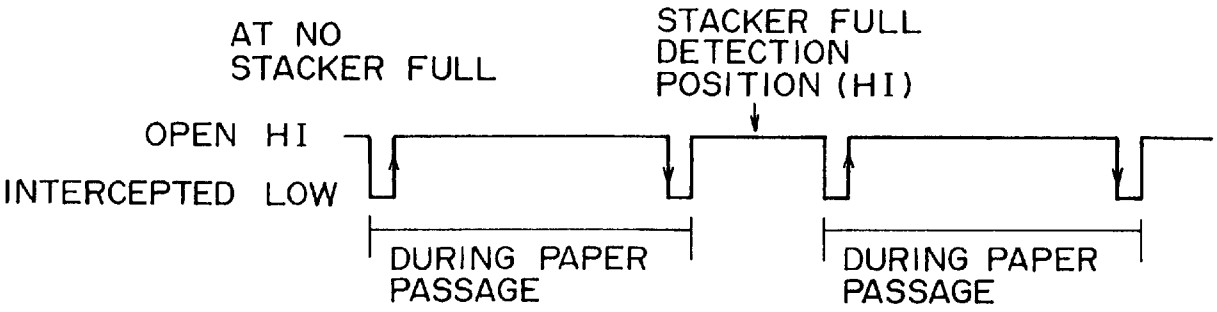
FIGS. 13A to 13C are illustrations of output examples of detection signals from the stacker sensor for describing the operations of the stacker sensor in this embodiment.

A brief description is to say that, when the stacker bin 113 is not in the full condition and the paper normally passes through the position of the stacker sensor 111, the stacker sensor 111 issues such an output signal as shown in FIG. 13A.

In the initial state, the optical transmission type sensor 130 is in its open condition, at which time the output signal of the optical transmission type sensor 130 is in a high-level condition. When both the end portions (the front end portion and the rear end portion) of the paper pass through the position of the stacker sensor 111, the intercepting member 134 of the detection lever 231 once cuts in the optical transmission type sensor 130 for the light interception, and hence, the output thereof turns to a low-level condition. Further, after being obstructed by the width of the intercepting member 134, the optical transmission type sensor 130 again returns to its open condition, so that the output signal thereof varies from its low level to its high level.

Owing to these output signals thereof, the mechanism control section 12 can detect that the paper normally passes through the position of the stacker sensor 111 and exits onto the stacker bin 113.

Figure 12A:
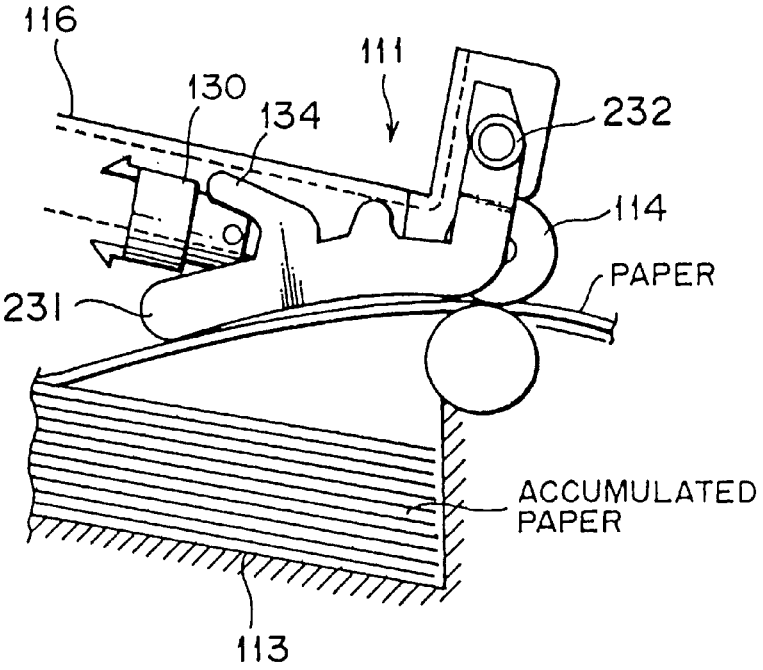
FIGS. 12A and 12B are illustrations useful for explaining an operation (operation to be taken for when the stacker reaches the paper full condition) of the stacker sensor in this embodiment.
Figure 12B:
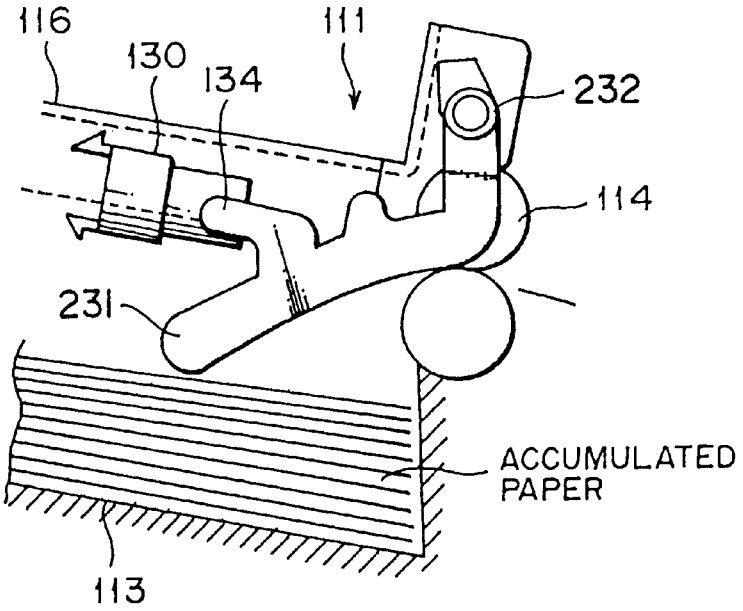
Figure 13B:
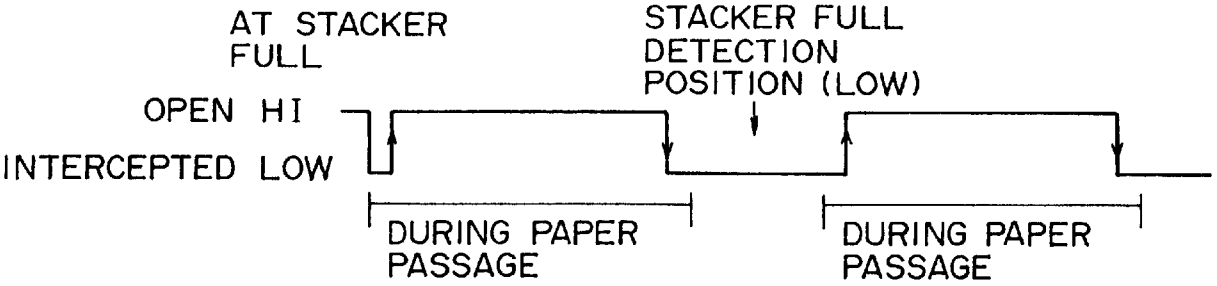

In case where a plurality of paper normally pass through the stacker sensor 111 and are accumulated on the stacker bin 113 to create the stacker full condition, as shown in FIG. 12A, due to the paper conveyed, the intercepting member 134 of the detection lever 231 of the stacker sensor 111 once intercepts the optical transmission type sensor 130 and then makes the optical transmission type sensor 130 again come into the open condition. Accordingly, as shown in FIG. 13B, the output of the stacker sensor 111 (that is, the output signal of the optical transmission type sensor 130) once changes from the high level to the low level and then again returns to the high level. If the stacker full condition takes place at the time when the paper is stored in the stacker bin 113, the detection lever 231 stops in the condition shown in FIG. 12B, so that the output signal of the optical transmission type sensor 130 remains in the low-level condition. Making use of this fact, the mechanism control section 12 is made to recognize the full condition of the stacker bin 113 at the time when confirming the elapse of a given time after the output signal of the stacker sensor 111 comes to the low level.

Still further, a description will be taken hereinbelow of the case that the paper suspends a the detection possible position of the stacker sensor 111. While the paper reaches and pass through the position of the stacker sensor 111, as shown in FIG. 12A, the detection lever 231 rotates and moves so that the intercepting member 134 once intercepts the light at the detection position of the optical transmission type sensor 130 and then again releases the optical transmission type sensor 130 from the interception condition. If the paper stays in this condition, the optical transmission type sensor 130 is being open as it is.

Figure 13C:
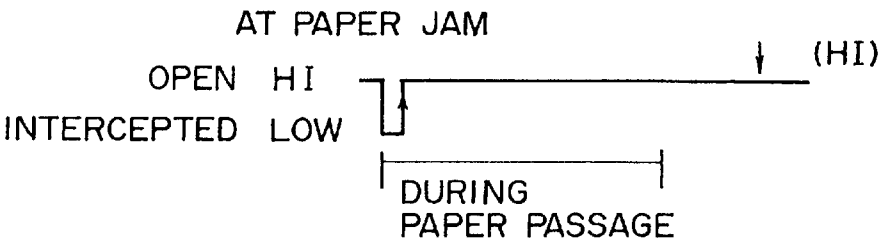

In more detail, as shown in FIG. 13C, in the initial state, the optical transmission type sensor 130 is in the open condition so that its output signal is in the high-level condition. Subsequently, when the paper reaches and passes through the position of the stacker sensor 111, because of the temporary light interception of the optical transmission type sensor 130 by the intercepting member 134 of the detection lever 231, the output signal once assumes the low-level condition. However, since the optical transmission type sensor 130 immediately again get back to the open condition, the output signal changes from the low level to the high level. On the other hand, if the paper stays due to its jam, the optical transmission type sensor 130 is left in the open condition, with the result that its output signal is kept to the low level not to show the variation that it once gets into the low level and then changes to the high level.

This allows the mechanism control section 12 to recognize the occurrence that the paper stops before discharged into the stacker bin 113, in other words, detects the paper condition.

Figure 14A:
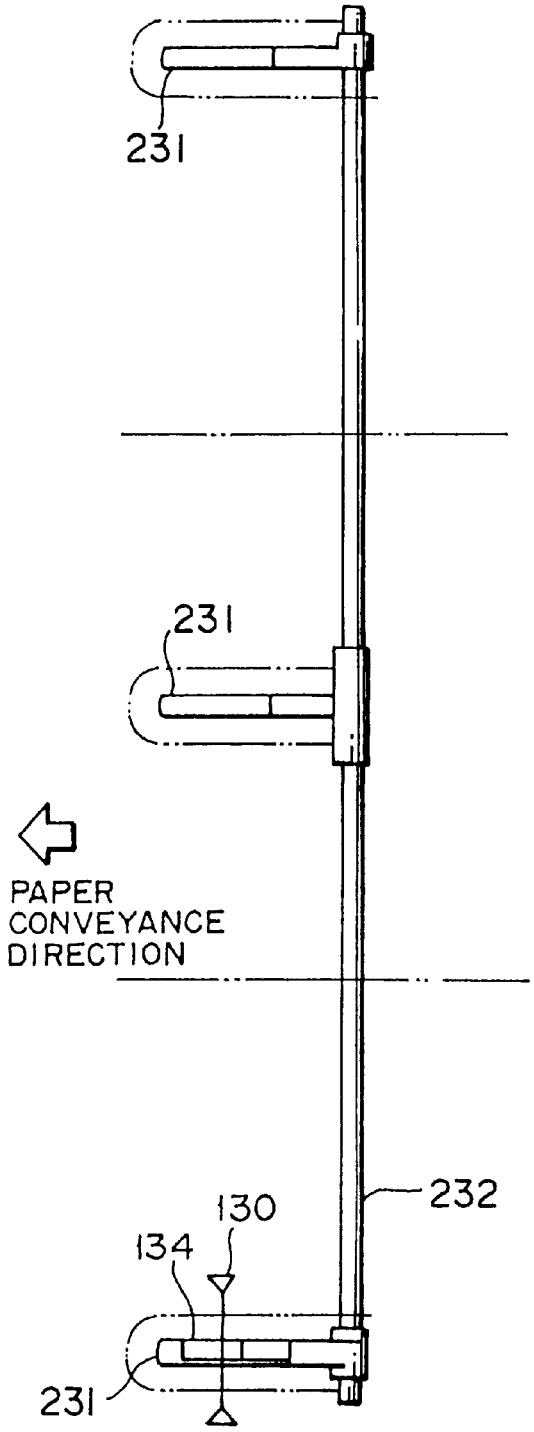
FIG. 14A is a plan view showing a detection lever and rotary lever shaft of the stacker sensor in this embodiment.

This stacker sensor 111 is, as shown in FIG. 14A, set in a state where the rotary lever shaft 132 is disposed in parallel to the width directions of the paper (the direction perpendicular to the paper conveying direction). Three detection levers each being the above-mentioned detection lever 231 for the detection of the paper are located at three places along the rotary lever shaft 232, respectively, thereby handling the paper with various sizes.

Figure 14B:
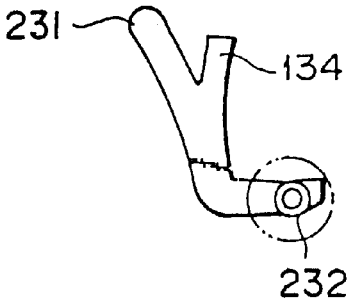
FIG. 14B is a side elevational view showing a detection lever with an intercepting member in the stacker sensor in this embodiment.
Figure 14C:
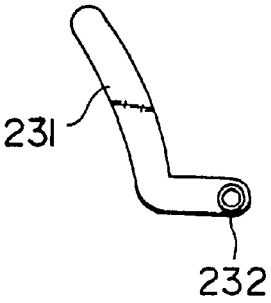
FIG. 14C is a side elevational view showing a detection lever of the stacker sensor in this embodiment.

As shown in FIGS. 14A and 14B, the intercepting member 134 is formed integrally with only one (the lower side in FIG. 14A) of the three detection levers 231, and the optical transmission type sensor 130 is disposed to sandwich the detection lever 231 integrally having the intercepting member 134. As shown in FIG. 14C, the remaining two detection levers 231 are not equipped with the intercepting member 134.

The plurality of detection levers 231, the intercepting member 134 and the rotary lever shaft 232 are molding-formed integrally, and the rotary lever 232 is rotatably fitted to the system casing (the casing of the option unit 110), so that the three detection levers 231 revolve together around the rotary lever shaft 232.

The use of such a stacker sensor 111 permits the detection of the three conditions: the normal discharge of the paper into the stacker bin 113, the paper full condition of the stacker bin 113 and the stop of the paper by jam.

Accordingly, the discharging condition of the paper into the stacker 11 (stacker bin 113) is detectable as follows through the use of the stacker sensor 111.

Figure 5:
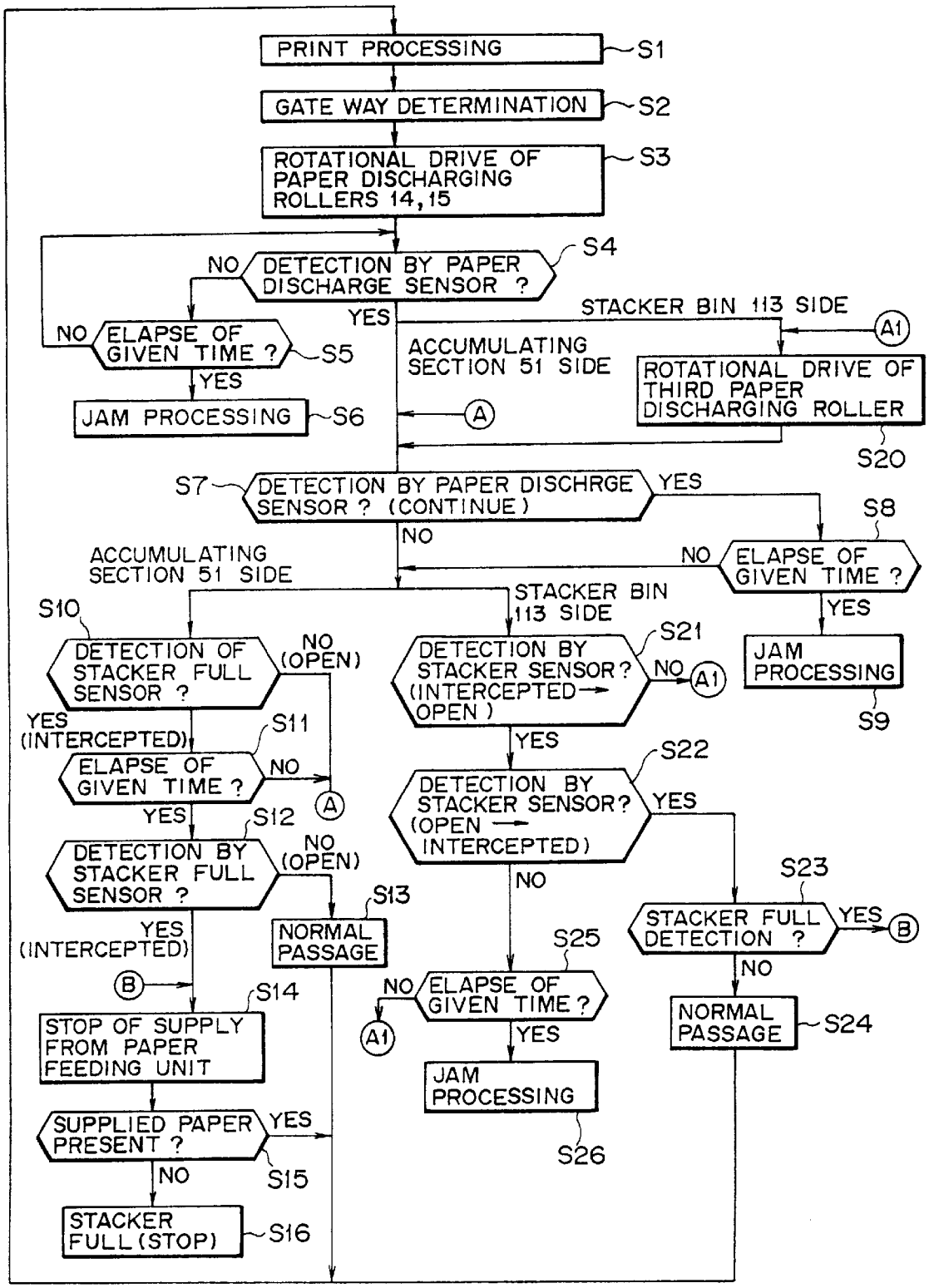
FIG. 5 is a flow chart available for describing a paper discharge condition detecting procedure into the stacker according to this embodiment.

When the decision of the step S2 in FIG. 5 is made that the sorting gate 115 is positioned to carry out the conveyance of the paper toward the stacker bin 113 side, after the detection of the paper by the paper discharge sensor 50 in the step S4 ("YES" route), the third paper discharging roller 114 is rotationally driven by the paper discharging motor 140 (step S20). The paper conveyed by the second paper discharging roller 15 is forwarded through the sorting gate 115 in the direction of the stacker bin 113 of the stacker 11.

The paper coming from the third paper discharging roller 114 rotates the detection lever 231 of the stacker sensor 111, and when detecting that, as mentioned above, the output signal of the stacker sensor 111 (the optical transmission type sensor 130) varies from the high level (open condition) to the low level (intercepted condition) and then again changes to the high level ("YES" route of step S21), the mechanism control section 12 makes a decision to that the front end portion of the paper reaches the position of the stacker sensor 111. The output signal thereof is maintained in the high-level condition during the passage of the paper as mentioned before with reference to FIGS. 13A to 13C.

Thereafter, when the output signal of the stacker sensor 111 changes from the high level to the low level ("YES" route in step S22) and further changes to the high level ("YES" route in step S23), the decision can be made that the rear end of the paper passes through the position of the stacker sensor 111. That is, the mechanism 12 makes a decision that the paper normally passes and is discharged to be accumulated in the stacker bin 113 (step S24), thus continuously executing the printing processing (step S1).

On the other hand, if the output signal of the stacker sensor 111 varies from the high level to the low level ("YES" route in step S22) but remaining in the low-level condition ("NO" route in step S23), the mechanism control section 12 decides that the paper is in the full condition within the stacker bin 113, and conducts the stacker full processing (steps S14 to S16).

Moreover, the paper conveyed by the third paper discharging roller 114 rotationally drives the detection lever 231 of the stacker sensor 111, and the output signal of the stacker sensor 111 changes from the high level to the low level and then again varies to the high level ("YES" route in step S21). Thereafter, in the case of no variation to the low level ("NO" route in step S22), the mechanism control section 12 monitors whether a given period of time set in advance through the experiments or the like elapses or not (step S25). That is, if the output signal of the stacker sensor 111 changes from the high level to the low level but remains in the high-level condition afterwards ("YES" route in step S25), the mechanism control section 12 makes a decision to the occurrence of paper jam and stops the printer system and further informs the user of the printer system of this jam occurrence (step S26).

In the case that the decision of the step S21 is made to that the output of the stacker sensor 111 varies from the high level to the low level but not again changing to the high level ("NO" route), or when the decision of the step S25 indicates no elapse of the given period of time ("NO" route), the operational flow returns to the step S20 where the third paper discharging roller 114 further rolls and the signals from the paper discharge sensor 50 and the stacker sensor 111 are put under the monitoring.

According to the above-described image formation system of this embodiment, on the basis of the output signals from one stacker sensor 111, it is possible to detect the normal discharge of the paper into the stacker bin 113, the fully accumulated condition of the paper in the stacker bin 113 and the stopping condition of the paper due to jam. Whereupon the operation of the image formation system is controllable in accordance with the detected discharge condition of the paper, that is, the appropriate control of the image formation system is feasible. Accordingly, even if faults such as the paper jam and the paper full condition occur within the system, it is possible to immediately take measures against that faults, which contributes to a higher reliability of the image formation system.

Furthermore, with an extremely simple arrangement in which the position of the intercepting member 134 of the detection lever 231 is detected through the use of the optical transmission type sensor 130, the above-mentioned three conditions (the success/failure of the discharge of the paper and the fully accumulated condition in the stacker bin 113) are surely detectable, and the structure of the image formation system can be given at a lower cost.

Still further, in this embodiment, when the fully accumulated condition of the paper in the stacker 11 (the accumulating section 51 or the stacker bin 113) is detected by the stacker sensor 111 or the stacker full sensor 112, the mechanism control section 12 controls the operation of the medium conveyance system to stop the discharge of the paper into the stacker 11, and further controls the operations of the medium conveyance system and the image formation section to stop the paper supply from the first paper feeding unit 3 and the image formation processing. Whereupon, it is possible to automatically inhibit the paper being in the discharge impossible condition from being discharged into the stacker 11, and therefore, less occurrence of fault in the stacker 11 is possible, thus enhancing the reliability of the image formation system.

The stacker sensor 111 (the medium detection unit according to this invention) and the medium conveyance system (the medium conveyance apparatus) applied to the printer system (the image formation system) according to this embodiment are also applicable to various systems (systems with a structure which discharges the medium through the medium conveyance system into the medium discharged section) but not limited to the printer system. Even in these cases, the same effects as mentioned above are obtainable.

What is claimed is:

1. A medium detection unit for detecting a condition of each of media being discharged through a medium conveyance system into a medium discharged section, said medium detection unit including a single sensor being made to output a signal indicative of a passage of said medium, a signal indicative of a fully accumulated condition of said media within said medium discharged section and a signal representative of the fact that said medium gets into a jam condition during the passage of said medium.

2. A medium detection unit for detecting a condition of each of media being discharged through a medium conveyance system into a medium discharged section, said medium detection unit comprising:

a movable member varying in position in accordance with movement of said medium while coming into contact with said medium; and a single sensor for sensing a position of said movable member to output a signal indicative of a passage of said medium, a signal indicative of a fully accumulated condition of said media within said medium discharged section and a signal representative of an occurrence of a jam condition of said medium during the passage of said medium.

3. A medium detection unit as defined in claim 2, wherein said movable member comprises:

a first member rotatably supported to be rotationally moved in accordance with the movement of said medium while coming into contact with said medium; and a second member designed to work on said sensor in conjunction with the rotational movement of said first member to vary an output signal of said sensor at the fully accumulated condition of said media relative to an output signal at the absence of said medium and to vary the output signal of said sensor with both end portions of said medium at the passage of said medium so that said output signal coincides with said output signal at the absence of said medium after being once varied with respect to said output signal at the absence of said medium.

4. A medium detection unit as defined in claim 3, wherein said sensor is of an optical transmission type composed of a light-emitting device and a light-receiving device, and said second member of said movable member is made as an interceptor capable of intercepting light between said light-emitting device and said light-receiving device of said optical transmission type sensor.

5. A medium conveyance apparatus comprising:

a medium conveyance system for conveying each of media;

a medium discharged section for accumulatively receiving said media discharged through said medium conveyance system;

a movable member varying in position in accordance with movement of said medium while coming into contact with said medium; and a single sensor for sensing a position of said movable member to output a signal indicative of a passage of said medium and a discharge of said medium into said medium discharged section, a signal indicative of a fully accumulated condition of said media within said medium discharged section and a signal representative of an occurrence of a jam condition of said medium during the passage of said medium.

6. A medium conveyance apparatus as defined in claim 5, wherein said movable member comprising:

a first member rotatably supported to be rotationally moved in accordance with the movement of said medium while coming into contact with said medium; and a second member designed to work on said sensor in conjunction with the rotational movement of said first member to vary an output signal of said sensor at the fully accumulated condition of said media relative to an output signal at the absence of said medium and to vary the output signal of said sensor with both end portions of said medium at the passage of said medium so that said output signal coincides with said output signal at the absence of said medium after being once varied with respect to said output signal at the absence of said medium.

7. A medium conveyance apparatus as defined in claim 6, wherein said sensor is of an optical transmission type composed of a light-emitting device and a light-receiving device, and said second member of said movable member is made as an interceptor capable of intercepting light between said light-emitting device and said light-receiving device of said optical transmission type sensor.

8. An image formation system comprising:

a storage section for storing media;

an image formation section for transferring an image onto each of said media for image formation;

a medium discharged section for accumulating said media each having said image transferred in said image formation section and discharged thereinto;

a medium conveyance system for drawing out each of said media from said storage section and further for discharging said medium into said medium discharged section after passing through said image formation section;

a movable member varying in position in accordance with movement of said medium while coming into contact with said medium; and a single sensor for sensing a position of said movable member to output a signal indicative of a passage of said medium and a discharge of said medium into said medium discharged section, a signal indicative of a fully accumulated condition of said media within said medium discharged section and a signal representative of an occurrence of a jam condition of said medium during the passage of said medium.

9. An image formation system as defined in claim 8, wherein said movable member comprising:

a first member rotatably supported to be rotationally moved in accordance with the movement of said medium while coming into contact with said medium; and a second member designed to work on said sensor in conjunction with the rotational movement of said first member to vary an output signal of said sensor at the fully accumulated condition of said media relative to an output signal at the absence of said medium and to vary the output signal of said sensor with both end portions of said medium at the passage of said medium so that said output signal coincides with said output signal at the absence of said medium after being once varied with respect to said output signal at the absence of said medium.

10. An image formation system as defined in claim 9, wherein said sensor is of an optical transmission type composed of a light-emitting device and a light-receiving device, and said second member of said movable member is made as an interceptor capable of intercepting light between said light-emitting device and said light-receiving device of said optical transmission type sensor.

11. An image formation system as defined in claim 8, further comprising a control section for controlling an operation of said medium conveyance system to stop a discharge of said medium into said medium discharged section when said sensor detects said fully accumulated condition of said media in said medium discharged section.

12. An image formation system as defined in claim 8, further comprising a control section for controlling operations of said medium conveyance system and said image formation section to stop drawing-out of said medium from said storage section and image formation processing in said image formation section when said sensor detects said fully accumulated condition of said media in said medium discharged section.

* * * * *